US010300580B2

(12) United States Patent
Yamamoto

(10) Patent No.: US 10,300,580 B2
(45) Date of Patent: May 28, 2019

(54) SHOT PROCESSING DEVICE

(71) Applicant: SINTOKOGIO, LTD., Nagoya-shi, Aichi (JP)

(72) Inventor: Masatoshi Yamamoto, Toyokawa (JP)

(73) Assignee: SINTOKOGIO, LTD., Nagoya-shi, Aichi (JP)

( * ) Notice: Subject to any disclaimer, the term of this patent is extended or adjusted under 35 U.S.C. 154(b) by 822 days.

(21) Appl. No.: 14/772,858

(22) PCT Filed: Oct. 17, 2013

(86) PCT No.: PCT/JP2013/078220
§ 371 (c)(1),
(2) Date: Sep. 4, 2015

(87) PCT Pub. No.: WO2014/136308
PCT Pub. Date: Sep. 12, 2014

(65) Prior Publication Data

US 2016/0016287 A1 Jan. 21, 2016

(30) Foreign Application Priority Data

Mar. 7, 2013 (JP) ..... 2013-045940

(51) Int. Cl.
*B24C 3/24* (2006.01)
*B24C 1/10* (2006.01)
(Continued)

(52) U.S. Cl.
CPC ..... *B24C 1/10* (2013.01); *B24C 3/00* (2013.01); *B24C 3/18* (2013.01)

(58) Field of Classification Search
CPC ..... B24C 1/10; B24C 3/18; B24C 3/00
(Continued)

(56) References Cited

U.S. PATENT DOCUMENTS 2,982,007 A * 5/1961 Fuchs ..... B24C 3/18 451/102
3,423,976 A * 1/1969 Burney ..... B24C 1/10 451/38
(Continued)

FOREIGN PATENT DOCUMENTS

CN 102649262 8/2012
DE 102008009311 9/2009
(Continued)

OTHER PUBLICATIONS

English-language translation of International Preliminary Report on Patentability (IPRP) dated Sep. 17, 2015 that issued in WO Patent Application No. PCT/JP2013/078220.

*Primary Examiner* — David B Jones
(74) *Attorney, Agent, or Firm* — Drinker Biddle & Reath LLP

(57) ABSTRACT

A hanging section is installed at an upper side of a cabinet, and an autorotation mechanism rotates the hanging section around an axis of the hanging section in upward/downward directions of a device. In addition, a hanger unit hanging from the hanging section is installed in a cabinet, and a pair of frame sections is parallelly installed in series to match opening directions. Then, projection machines project a shot media toward the hanger unit. In addition, a loading/unloading device installed outside the cabinet is configured such that arm constituting a part thereof can be inserted into an opening section of the frame section of the hanger unit, and a tray on which a workpiece is placed can be conveyed. The loading/unloading device loads/unloads the tray with respect to the hanger unit by advancing and retracting the arm.

12 Claims, 20 Drawing Sheets

(51) Int. Cl.
*B24C 3/00* (2006.01)
*B24C 3/18* (2006.01)

(58) Field of Classification Search
USPC ..... 72/53
See application file for complete search history.

(56) References Cited

U.S. PATENT DOCUMENTS 3,566,644 A * 3/1971 Moore ..... B24C 3/00
59/9
2011/0094281 A1 4/2011 Oyama

FOREIGN PATENT DOCUMENTS

| | | |
|---|---|---|
| EP | 0248096 | 12/1987 |
| JP | H4-171177 | 6/1992 |
| JP | H4-112772 | 9/1992 |
| JP | H4-112773 | 9/1992 |
| JP | H9-076157 | 3/1997 |
| JP | H10-034538 | 2/1998 |
| JP | 2010-082727 | 4/2010 |
| WO | WO 2013/011736 | 1/2013 |

* cited by examiner

SHOT PROCESSING DEVICE

TECHNICAL FIELD

Aspects and embodiments of the present invention are related to a shot processing device for projecting a shot media to a workpiece.

BACKGROUND ART

As a shot blasting device, a hanger type shot blasting device is known (for example, see Patent Literature 1). In such a device, for example, in order to process a product to be treated (a workpiece) without surface irregularity, a jig (secondarily hooks the hanger) matched to a shape of the product to be treated is used.

CITATION LIST

Patent Literature

[Patent Literature 1] Japanese Unexamined Patent Application Publication No. H09-76157

SUMMARY OF INVENTION

Technical Problem

The jig matched to the product to be treated, however, should be exchanged with a new one when a type of the product to be treated is varied in the device. Therefore, processing of various types of products to be treated is time-consuming.

There is demand in this technical field for a shot processing device capable of reducing processing time when various types of workpieces are processed.

Solution to Problem

A shot processing device according to an aspect of the present invention has a cabinet formed in a box shape; a hanging section installed in the cabinet and extending in device upward/downward directions; an autorotation mechanism configured to rotate the hanging section around an axis of the hanging section; a hanger unit suspended from the hanging section and installed in the cabinet, and including a pair of frame sections each having an upper frame section, a lower frame section, and a pair of side frame sections, wherein the pair of frame sections is parallelly installed in series to coincide with the opening direction; a projection machine configured to project a shot media toward the hanger unit; and a loading/unloading device installed outside the cabinet, including an arm insertable into an opening section of the frame section of the hanger unit and configured to convey a tray on which a workpiece is placed, wherein the tray is loaded into/unloaded from the hanger unit by advancing and retracting the arm.

According to the shot processing device, the hanging section is installed in the cabinet, and the autorotation mechanism rotates the hanging section around the axis of the hanging section in the upward/downward directions of the device. In addition, the hanger unit hanging from the hanging section includes the pair of frame sections installed in the cabinet and each having the upper frame section, the lower frame section, and the pair of side frame sections, and the pair of frame sections is parallelly installed in series to match the opening directions. Then, the projection machine projects the shot media toward the hanger unit. In addition, the loading/unloading device installed outside the cabinet can cause the arm constituting the part thereof to be inserted into the opening section of the frame section of the hanger unit and convey the tray on which the workpiece is placed, and the tray can be loaded/unloaded with respect to the hanger unit by advancing and retracting the arm. For this reason, even when a type of the workpiece is varied, the shot processing can be performed without exchanging a jig. Accordingly, a processing time when a variety of workpieces are processed can be reduced by removing an exchanging time of the jig.

In one embodiment, in the hanger unit, upper surface sections of intermediate sections in leftward/rightward width directions of lower frame sections of the pair of frame sections may be connected by a connecting section, and the tray may be placed on the connecting section. Then, the arm may be provided in a pair, and the pair of arms may be installed to place the tray and may be inserted into left and right sides of the connecting section in the opening section of the frame section. Then, the thickness in the upward/downward directions of a placing section on which the tray is placed in the aims may be set to be smaller than a distance in the upward/downward direction between a placing surface of the tray of the connecting section and an upper surface of the lower frame section. Further, the loading/unloading device may include an elevating mechanism configured to elevate the arms.

In this case, in the hanger unit, the upper surface sections of the intermediate sections in the leftward/rightward width directions of the lower frame sections of the pair of frame sections are connected by the connecting section, and the tray can be placed on the connecting section. On the other hand, the arms are installed as a pair to place the tray, can be inserted into the left and right sides of the connecting section in the opening section of the frame section, and are elevated by the elevating mechanism. Then, the thickness in the upward/downward directions of the placing section on which the tray is placed in the arms is set to be smaller than the distance in the upward/downward direction between the placing surface of the tray of the connecting section and the upper surface of the lower frame section. For this reason, after the arms on which the tray is placed is advanced to be inserted into the left and right sides of the connecting section of the opening section of the frame section, when the elevating mechanism lowers the arms, the tray can be placed on the connecting section of the hanger unit, and then, only the arms can be retracted. That is, the tray can be stably loaded on the hanger unit while providing a simple configuration.

In one embodiment, the shot processing device may have an angle position detection unit configured to detect an initial setting position such that the opening section of the frame section of the hanger unit is directed toward the arm, among rotational angle positions around an axis in the device upward/downward directions of the hanging section; and an autorotation control unit configured to control an operation of the autorotation mechanism to stop the hanging section at the initial setting position based on a detection result of the angle position detection unit.

In this case, the initial setting position set such that the opening section of the frame section of the hanger unit is directed toward the arm, among the rotational angle positions around the axis in the device upward/downward directions of the hanging section, is detected by the angle position detection unit. The autorotation control unit can control the operation of the autorotation mechanism to stop the hanging section at the initial setting position based on the detection result of the angle position detection unit. For this reason, when the tray is loaded into/unloaded from the hanger unit, the arm is easily inserted into the frame section of the hanger unit.

In one embodiment, the shot processing device may have a loading-side delivery unit installed outside the cabinet and configured to place the trays in a state of stacked in a plurality of stages; a transportation conveyor installed outside the cabinet, having an upstream side in a transportation direction disposed in the vicinity of the loading-side delivery unit, disposed to cross an operation region of the loading/unloading device, and configured to transport the tray; an unloading-side delivery unit installed outside the cabinet, disposed in the vicinity of the downstream side in the transportation direction of the transportation conveyor, and configured to place the trays in the state of stacked in the plurality of stages; a dispensing device installed in the vicinity of the loading-side delivery unit and the upstream side in the transportation direction of the transportation conveyor, and configured to sequentially transfer the trays stacked in the plurality of stages of the loading-side delivery unit from the tray of an upper stage side to be placed on the transportation conveyor; and a stacking device installed in the vicinity of the downstream side in the transportation direction of the transportation conveyor and the unloading-side delivery unit. Then, the loading/unloading device may load the tray transferred by the dispensing device and transported by the transportation conveyor to the hanger unit, and unload the tray from the hanger unit to place the tray on the transportation conveyor. In addition, the stacking device may be on standby while gripping and raising the tray unloaded by the loading/unloading device and transported by the transportation conveyor, and lower and grip the tray when another tray is transmitted to immediately under the standby position, and further place the trays in the state of stacked in the plurality of stages on the unloading-side delivery unit.

In this case, the loading-side delivery unit, the transportation conveyor, and the unloading-side delivery unit are installed outside the cabinet. In the loading-side delivery unit, the trays can be placed in the state of stacked in the plurality of stages. In addition, the dispensing device installed in the vicinity of the loading-side delivery unit and the upstream side in the transportation direction of the transportation conveyor sequentially transfers the trays stacked in the plurality of stages in the loading-side delivery unit from the tray of the upper stage side to place the trays on the transportation conveyor. The transportation conveyor is disposed to cross the operation region of the loading/unloading device, and transports the tray transferred by the dispensing device. In addition, the loading/unloading device loads the tray transferred by the dispensing device and transported by the transportation conveyor to the hanger unit, and unloads the tray from the hanger unit to place the tray on the transportation conveyor. Accordingly, the workpiece placed on the tray is returned to the transportation conveyor after the shot processing.

The transportation conveyor transports the tray unloaded by the loading/unloading device. In addition, the stacking device installed in the vicinity of the downstream side in the transportation direction of the transportation conveyor and the unloading-side delivery unit can be on standby by gripping and raising the tray unloaded by the loading/unloading device and transported by the transportation conveyor, lowered to grip the tray when another tray is transported to immediately under the standby position, and further, places the trays in the state of stacked in the plurality of stages on the unloading-side delivery unit. Accordingly, the trays are transferred by the dispensing device to be stacked in the same vertical relationship to be placed on the unloading-side delivery unit. For this reason, for example, even when the trays cannot be stacked due to an occurrence of distortion or the like in the tray and a variation in the vertical relationship in comparison with the case before being transferred, the trays can be provided as the processing targets.

In one embodiment, the stacking device may include an elevating unit configured to elevate a clamp configured to grip the tray; a clamp jaw constituting a part of the clamp and rotatable around an axis in a horizontal direction between a support posture at which the clamp jaw is able to support a bottom surface of the tray and a retract posture at which the clamp jaw is rotated upward to be retracted when coming in contact with a side surface of the tray upon lowering; and a biasing mechanism constituting a part of the clamp and configured to bias the clamp jaw in a direction from a rotational angle position of the retract posture toward a rotational angle position of the support posture.

In this case, the elevating unit elevates the clamp used to grip the tray in the stacking device. The clamp jaw constituting the part of the clamp can be rotated around the axis in the horizontal direction between the support posture at which the clamp jaw is able to support the bottom surface of the tray and the retract posture at which the clamp jaw is rotated upward to be retracted when coming in contact with the side surface of the tray upon lowering. In addition, the biasing mechanism biases the clamp jaw in the direction from the rotational angle position of the retract posture toward the rotational angle position of the support posture. For this reason, the clamp jaw can be retracted even when the tray is transported to immediately under the standby position to lower the clamp jaw, and when the clamp jaw is lowered beyond the side surface lower end of the tray, the clamp jaw can support the bottom surface of the tray at the support position using the biasing force of the biasing mechanism.

In one embodiment, the shot processing device may have a spraying device configured to spray a gas toward the hanger unit in the cabinet.

In this case, the spraying device can spray the gas toward the hanger unit in the cabinet. Accordingly, as the spraying device sprays the gas toward the hanger unit after the projection machine projects the shot media toward the hanger unit, discharging of the shot media from the cabinet is prevented or effectively suppressed.

In one embodiment, the shot processing device may include a rotary rotatably installed around the axis in the device upward/downward directions in the cabinet to divide a space around the axis by partition sections such that a plurality of processing chambers are installed in parallel in a circumferential direction, and opening sections opened at an outer circumferential side and used for loading of the tray, unloading of the tray and passing of a shot media are formed in the processing chambers; and a rotary drive mechanism configured to rotate the rotary around the axis of the rotary. Then, the projection machine may project a shot media into the processing chamber through the opening section of the processing chamber. Then, the hanging section may be installed at a ceiling section of the rotary. Then, the rotary drive mechanism may revolve the hanging section by rotating the rotary, and primarily stop the rotary using a predetermined position of a projection area in which a workpiece is projected by the projection machine as a revolution stoppage position.

In this case, as the rotary is rotatably installed around the axis in the device upward/downward directions in the cabinet to divide the space around the axis by the partition sections, the plurality of processing chambers are formed in parallel in the circumferential direction, and the opening sections opened toward the outer circumferential side and used for the loading of the tray, the unloading of the tray, and the passage of the shot media are formed in the processing chambers. On the other hand, the projection machine projects the shot media into the processing chambers through the opening sections of the processing chambers. In addition, the rotary drive mechanism revolves the hanging section installed at the ceiling section of the rotary by rotating the rotary around the axis of the rotary, and primarily stops the rotary using the predetermined position of the projection area in which shot media is projected toward the workpiece by the projection machine at the revolution stoppage position. Accordingly, the tray from the rotary can be unloaded and loaded in the area other than the projection area upon projection by the projection machine.

Advantageous Effects of Invention

As described above, according to the aspects and embodiments of the present invention, processing time when various types of workpieces are processed can be remarkably reduced.

DESCRIPTION OF EMBODIMENTS

[First Embodiment]

Figure 1:
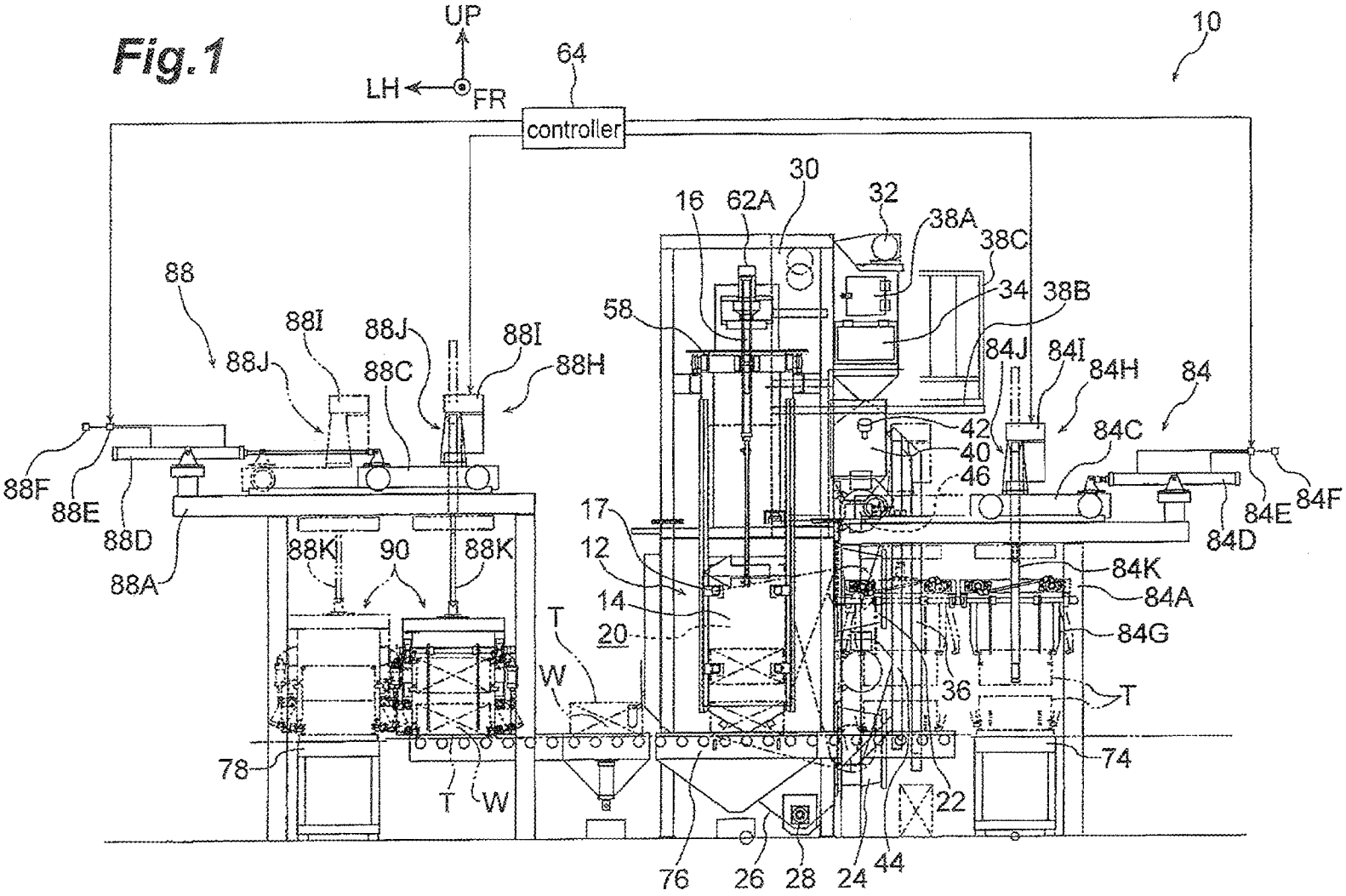
FIG. 1 is a front view showing a shot blasting device according to a first embodiment.

A shot blasting device serving as a shot processing device according to a first embodiment of the present invention will be described with reference to FIGS. 1 to 6. Further, as appropriately shown in the drawings, an arrow FR represents a front side when seen in a front view of the device, an arrow UP represents an upper side of the device, and an arrow LH represents a left side when seen in the front view of the device.

Figure 2:
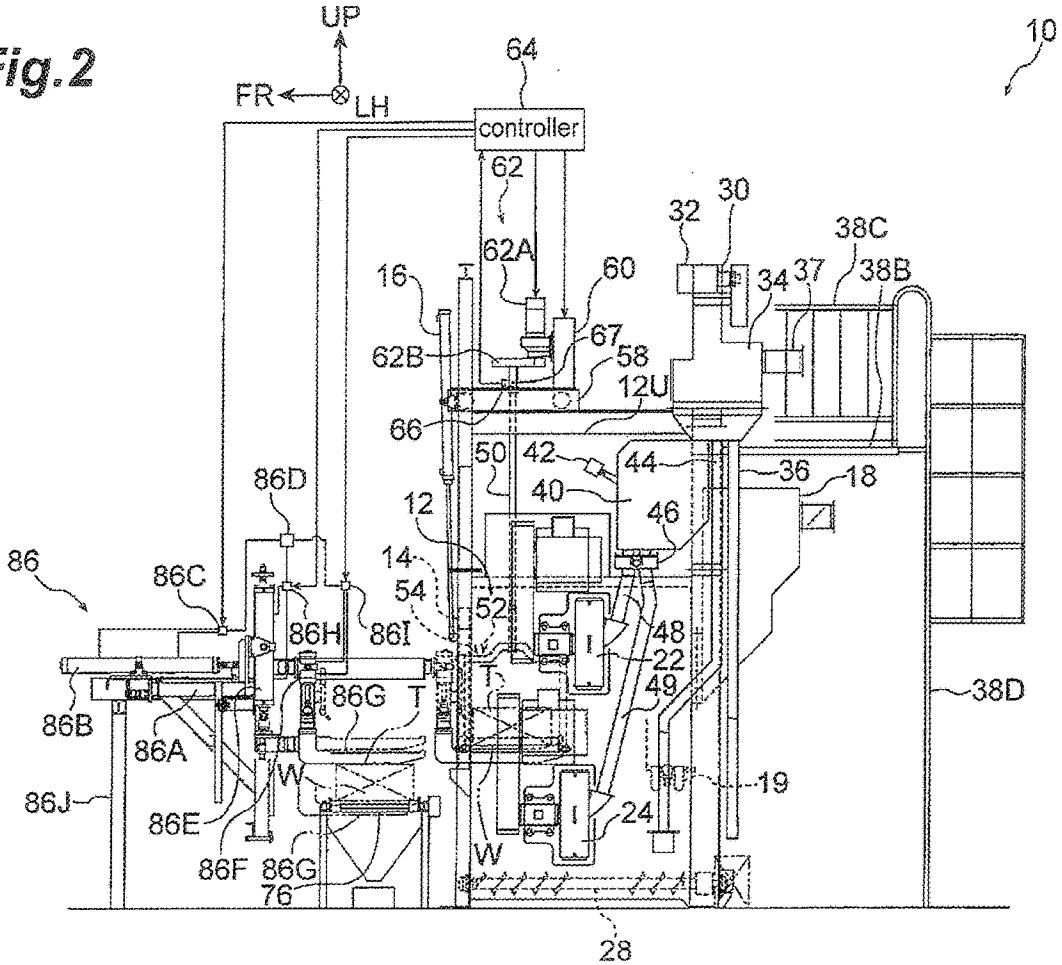
FIG. 2 is a side view showing the shot blasting device according to the first embodiment.
Figure 3:
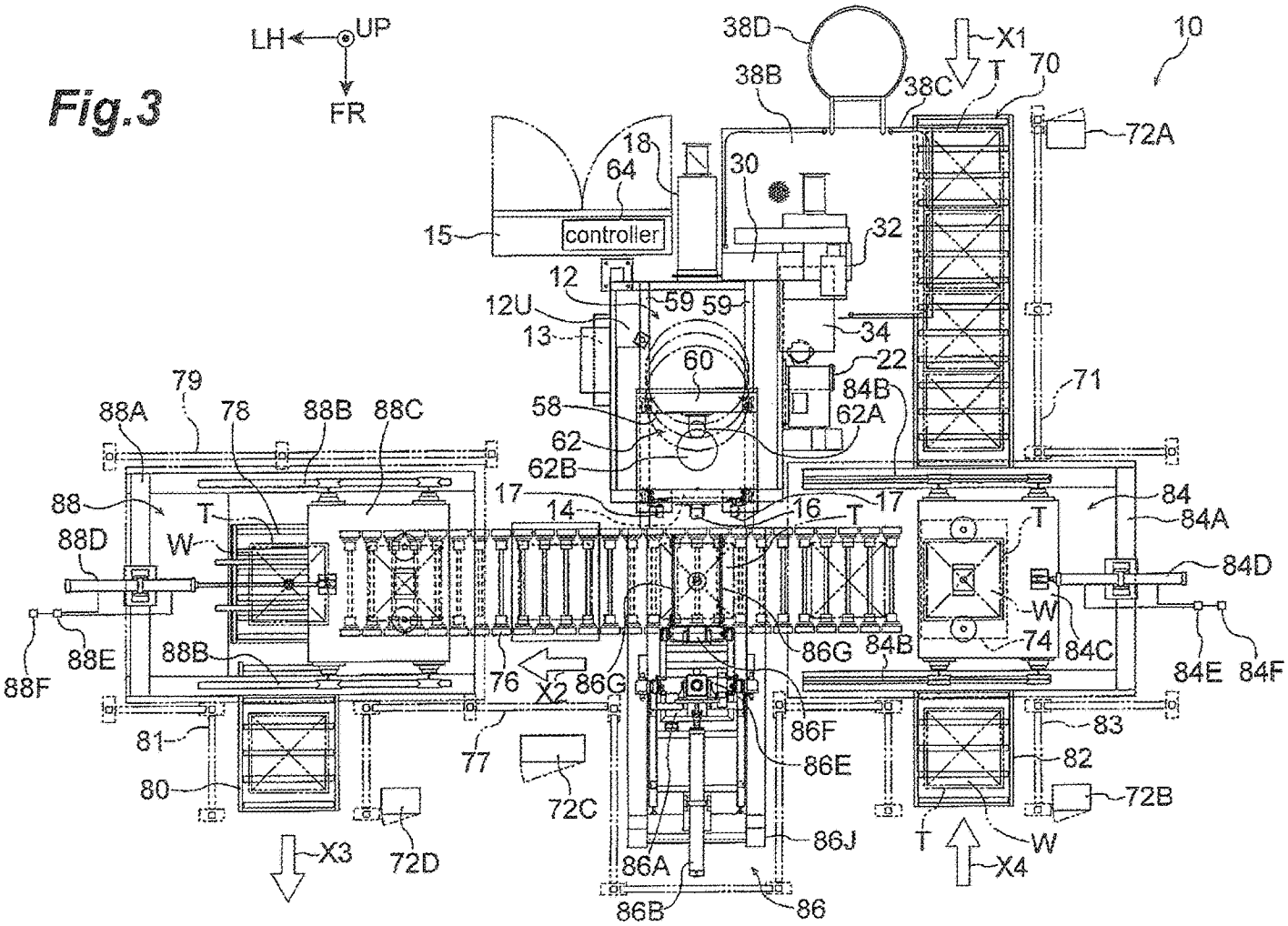
FIG. 3 is a plan view showing the shot blasting device according to the first embodiment.

FIG. 1 is a front view showing a shot blasting device 10 serving as a shot processing device, FIG. 2 is a side view showing the shot blasting device 10, and FIG. 3 is a plan view showing the shot blasting device 10.

Figure 4:
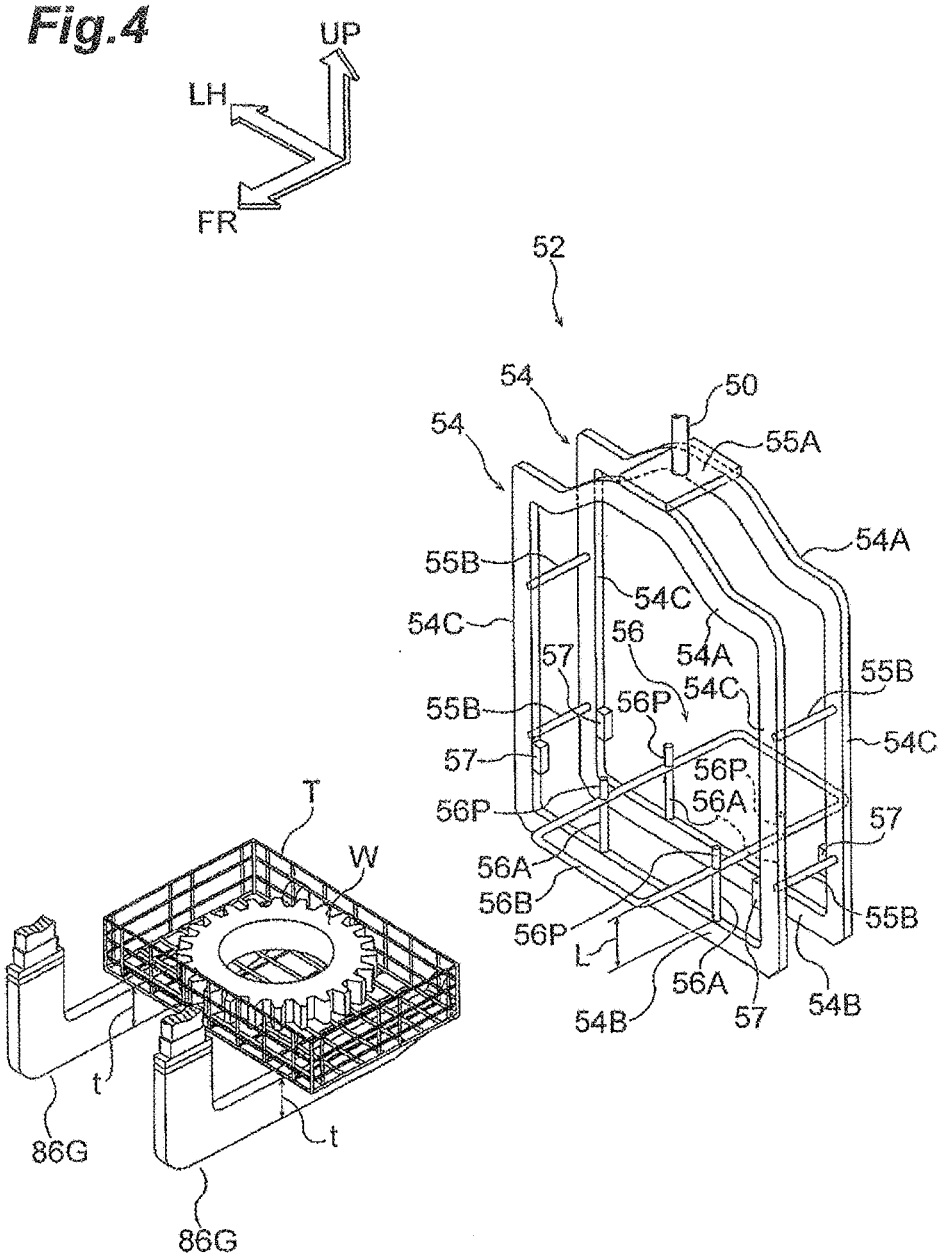
FIG. 4 is a perspective view showing a hanger unit or the like of the shot blasting device according to the first embodiment.

The shot blasting device 10 shown in FIGS. 1 to 3 transports a workpiece W placed on a tray T and processes the workpiece W through shot blasting (remove burrs, scales, or the like, using a shot media). Further, a plurality of trays T can be stacked up, and a plurality of hole sections are formed in each of the trays T. As shown in FIG. 4, for example, a mesh-shaped heat treatment tray may be used as the tray T. In addition, for example, parts such as a gear, a shaft, a transmission, and so on, may be used as the workpiece W.

(Configuration in Cabinet and Peripheral Parts Thereof)

As shown in FIGS. 1 to 3, the shot blasting device 10 includes a cabinet 12 formed in a box shape. As shown in FIG. 1, an elevating door 14 is disposed in an opening in the front of the cabinet 12. A cylinder 16 configured to elevate the elevating door 14 is installed over the elevating door 14. The elevating door 14 opens and closes the opening in the front of the cabinet 12 according to an operation of the cylinder 16. In addition, four corner sides of the elevating door 14 in the closed state are pressed by a door pressing cylinder 17, and thus, sealing of the elevating door 14 in the closed state is improved.

The cylinder 16 and the door pressing cylinder 17 are connected to an air supply source (not shown) via air direction control mechanisms (electromagnetic valves, and so on), which are not shown, respectively, and the air direction control mechanisms are connected to the controller 64. The controller 64 controls a direction of expansion and contraction of each rod of the cylinder 16 and the door pressing cylinder 17 by controlling the air direction control mechanisms.

Meanwhile, as shown in FIG. 2, an exhaust port 18 and an air pipe 19 are installed at a rear surface side of the cabinet 12. In addition, as shown in FIG. 3, a control panel 15 is installed at a device left side with respect to the exhaust port 18, and an inspection door 13 is installed at a side surface (a shot media reflective surface) side of the cabinet 12 in the device front side of the control panel 15.

A projection chamber 20 in which the surface processing (shot blast processing) of the workpiece W is performed by projection of the shot media to the workpiece W is formed in the cabinet 12 shown in FIG. 1. The projection of the shot media to the workpiece W is performed by projection machines 22 and 24. The projection machines 22 and 24 are attached to a sidewall of the cabinet 12 at a device right side in pairs at upper and lower sides. Further, the projection machines 22 and 24 will be described below.

A shot media collecting hopper 26 is formed at a lower side of the projection chamber 20, and a screw conveyor 28 is disposed at a lower end side of the hopper 26. As shown in FIG. 2, a downstream side in a transportation direction (a right side of FIG. 2) of the screw conveyor 28 is disposed in the vicinity of a lower end section of a bucket elevator 30 extending in the device upward/downward directions. The screw conveyor 28 and the bucket elevator 30 are driven by a driving motor 32 disposed in vicinity of an upper section of the bucket elevator 30. The screw conveyor 28 transports the shot media or the like collected by the hopper 26 (see FIG. 1) in a direction toward a rear surface of the cabinet 12 (a rightward direction of FIG. 2), and the bucket elevator 30 transports the shot media or the like toward an upper side of the device.

An air-powered separator 34 is disposed in the vicinity of an upper end section of the bucket elevator 30, and the shot media or the like transported by the bucket elevator 30 is input into the separator 34. Further, a separator inspection door 38A (see FIG. 1) used for maintenance of the separator 34 is installed at the separator 34, and a platform 38B and a handrail 38C are installed around the separator 34 (see FIG. 3). In addition, a ladder 38D for climbing the platform 38B is installed at a device back side (a right side of FIG. 2).

The separator 34 separates a usable shot media from unusable foreign substances. A rough material discharge pipe 36 is connected to the separator 34. An unusable rough foreign substance separated by the separator 34 is discharged through the rough material discharge pipe 36. In addition, the separator 34 is connected to a dust collector (not shown) via a duct 37. The unusable fine foreign substance separated by the separator 34 is suctioned into the dust collector via the duct 37 with air. The foreign substance suctioned into the dust collector enters a dust receiver in a lower section of the dust collector as dust, whereas, the air suctioned into the dust collector is cleaned and discharged. A shot tank 40 for storing the shot media is installed at a lower side of the separator 34. A usable shot media separated by the separator 34 enters the shot tank 40.

A level gauge 42 configured to detect an amount of the shot media in the shot tank 40 is installed at the shot tank 40, and the projection amount is managed using a detection result of the level gauge 42. An overflow pipe 44 is installed in the vicinity of an upper opening of the shot tank 40. When the shot media input into the shot tank 40 is excessive, the excessive amount is returned to the lower section of the cabinet 12 via the overflow pipe 44. A flow rate controller 46 is connected to a bottom section side of the shot tank 40. The flow rate controller 46 is a device configured to control supply of the shot media to the projection machines 22 and 24, and is connected to the controller 64 (a connection state is not shown). The controller 64 controls a supply amount of the shot media through the flow rate controller 46. As shown in FIG. 2, introduction pipes 48 and 49 are installed at a lower side of the flow rate controller 46, and the flow rate controller 46 is connected to the projection machines 22 and 24 via the introduction pipes 48 and 49. The introduction pipes 48 and 49 are pipes configured to supply the shot media to the projection machines 22 and 24.

Meanwhile, a hanging section 50 is installed at an upper side of the cabinet 12. The hanging section 50 is suspended from a ceiling section 12U side of the cabinet 12. Then, a hanger unit 52 (an element recognized also as "a tray receiver" or "a hanger hook") is suspended from the hanging section 50. The hanger unit 52 is installed in the cabinet 12.

FIG. 4 is a perspective view showing the hanger unit 52 or the like. As shown in FIG. 4, the hanger unit 52 includes a pair of frame sections 54. The frame section 54 has an upper frame section 54A, a lower frame section 54B, and a pair of side frame sections 54C. Then, the pair of frame sections 54 is installed in parallel and serially to coincide with the opening direction.

Upper surface sections of intermediate sections in leftward/rightward width directions of the upper frame sections 54A of the pair of frame sections 54 are connected by a connecting plate section 55A, and the connecting plate section 55A is suspended from the hanging section 50. In addition, in the intermediate sections in the upward/downward directions of the side frame sections 54C of the pair of frame sections 54, opposing sections in a parallel installation direction of the pair of frame sections 54 are connected by a connecting pin 55B. Further, the upper surface sections of the intermediate section in the leftward/rightward width directions of the lower frame sections 54B of the pair of frame sections 54 are connected by a connecting section 56.

The connecting section 56 includes standing sections 56A projecting from the intermediate sections in the leftward/rightward width directions of the lower frame sections 54B of the pair of frame sections 54 and installed in parallel in the leftward/rightward width direction. The upper end sections of the standing sections 56A are connected by a tray receiving section 56B having a substantially rectangular frame shape when seen in a plan view. The tray receiving section 56B overhangs at both sides in the parallel installation direction of the pair of frame sections 54 with respect to the pair of frame sections 54 when seen in the plan view. Then, the hanger unit 52 is configured so that the tray T is inserted into the opening section of the frame section 54, and the tray T is placed on the tray receiving section 56B of the connecting section 56. Further, as described above, the workpiece W is placed on the tray T.

In addition, in the opposing sections of the pair of side frame sections 54C of the frame section 54, convex sections 57 are installed at a range including a height position slightly higher than the tray receiving section 56B. The convex sections 57 are projected outward in the opposite directions of the pair of side frame sections 54C, and displacement in a lateral direction of the tray T is restricted as the convex sections 57 come in contact with a lower end of a side section of the tray T.

In addition, protrusion pins 56P projecting upward from the tray receiving section 56B at an upper side of the standing section 56A are provided. In a state in which the tray T is placed on the tray receiving section 56B, the protrusion pins 56P pass through the mesh of the tray T. Accordingly, the hanger unit 52 can stably support the tray T.

The above-mentioned projection machines 22 and 24 shown in FIG. 2 project the shot media toward the hanger unit 52. The projection machines 22 and 24 include rotatable impellers (not shown), and are centrifugal projection machines configured to apply a centrifugal force to the shot media by rotation of the impellers. The projection machines 22 and 24 are configured to project the shot media accelerated by the centrifugal force toward the workpiece W according to rotation of the impellers. A driving motor configured to drive the impellers is connected to the controller 64, and an operation thereof is suppressed by the controller 64. Further, in FIG. 1, two-dot chain lines extending from the projection machines 22 and 24 show a projection range.

Meanwhile, the hanging section 50 shown in FIG. 2 is attached to a trolley 58 installed at the ceiling section 12U of the cabinet 12 via a bearing. As shown in FIG. 3, the trolley 58 can travel (move) along a pair of left and right guide rails 59 installed at an upper surface of the ceiling section 12U of the cabinet 12 in the device forward/rearward direction. As shown in FIG. 2, a travel driving motor 60 configured to move the trolley 58 is attached to the trolley 58. The trolley 58 travels from a device front side toward a device back side by the forward rotation of the travel driving motor 60, and travels from the device back side toward the device front side by the reverse rotation of the travel driving motor 60.

The travel driving motor 60 is connected to the controller 64, and an operation thereof (forward rotation, reverse rotation, stoppage, and a rotation speed) is controlled by the controller 64. In the embodiment, the controller 64 controls the operation of the travel driving motor 60 such that the hanger unit 52 three-point stops at a predetermined position in the projection zone (see the two-dot chain lines of FIG. 3). Further, the controller 64 may control the operation of the travel driving motor 60 to, for example, one-point stop the hanger unit 52 in the projection zone, other than the three-point stoppage. In addition, the controller 64 may control the operation of the travel driving motor 60 such that the hanger unit 52 entering a central region of the projection zone moves at a lower speed than before entering the central region of the projection zone.

As shown in FIGS. 2 and 3, an autorotation mechanism 62 configured to rotate the hanging section 50 around an axis of the hanging section 50 in the device upward/downward directions is installed at an upper side of the trolley 58. The autorotation mechanism 62 includes an autorotation driving motor 62A attached to a casing of the travel driving motor 60. A driving gear is fixed to an output shaft of the autorotation driving motor 62A, and a driven gear 62B is meshed with the driving gear. An upper end section side of the hanging section 50 is fixed to the central section of the driven gear 62B. That is, the hanging section 50 is rotated around the axis in the device upward/downward directions according to rotation of the autorotation driving motor 62A. As shown in FIG. 2, the autorotation driving motor 62A is connected to the controller 64, and an operation thereof (forward rotation, reverse rotation, stoppage, and a rotation speed) is controlled by the controller 64.

Further, as the trolley 58, the travel driving motor 60 and the autorotation mechanism 62 are disposed at the ceiling section 12U of the cabinet 12, installation areas of these are reduced, and a contribution to a more compact structure is realized.

An angle position detection unit 66 (shown as a block in FIG. 2) is installed at the trolley 58. The angle position detection unit 66, as an example, is a proximity switch attached to the front surface side of the device with respect to the hanging section 50 on the trolley 58. On the other hand, a metal piece 67 is formed in the hanging section 50 at the same height position as the angle position detection unit 66. The metal piece 67 is attached to a front surface of the hanging section 50 when seen in a front view of the hanger unit 52 (when seen in a direction in which the opening section of the frame section 54 is directed toward the front surface). The angle position detection unit 66 is configured to be electrically connected to an electric circuit (a control circuit unit) including the angle position detection unit 66 when the metal piece 67 approaches. Accordingly, the angle position detection unit 66 is configured to detect an initial setting position set such that the opening section of the frame section 54 in the hanger unit 52 among the rotational angle positions around the axis in the device upward/downward directions of the hanging section 50 is directed toward the front surface side of the device (a side of arms 86G described below).

The angle position detection unit 66 is connected to the controller 64 serving as the autorotation control unit. The controller 64 can control an operation of the autorotation mechanism 62 (the autorotation driving motor 62A) to stop the hanging section 50 at the initial setting position (a position rotated 90° around the axis of the hanging section 50 from the state shown in FIG. 2) based on the detection result of the angle position detection unit 66.

(Configuration of Transportation Mechanism or the Like Outside Cabinet)

Next, the transportation mechanism installed outside the cabinet 12 will be described.

As shown in FIG. 3, a stock roller conveyor 70 is installed at the device right side with respect to the cabinet 12. A safety fence 71 is installed at the device right side with respect to the stock roller conveyor 70. The stock roller conveyor 70 is configured such that a direction (an arrow X1 direction) from the device back side toward the device front side is directed in the transportation direction, and a plurality of conveyor rollers are rotatably supported by conveyor base frames installed at both sides in the transportation width direction. The plurality of conveyor rollers are arranged in the transportation direction (the arrow X1 direction), connected to a driving motor (not shown) via the driving force transmission mechanism, and configured to rotate by the driving force of the driving motor. Then, the stock roller conveyor 70 can be placed in a state in which the trays T are stacked in the plurality of stages, and transports the trays T in the state of stacked in the plurality of stages.

An entrance manipulation panel 72A is disposed at the device right side at the most upstream side in the transportation direction of the stock roller conveyor 70, and the entrance manipulation panel 72A is connected to the controller 64 (the connection state is not shown). In addition, the driving motor configured to drive the stock roller conveyor 70 is connected to the controller 64, and the operation thereof is controlled by the controller 64 according to manipulation information of the entrance manipulation panel 72A.

A loading-side delivery roller conveyor 74 (see FIG. 1) is disposed in the vicinity of the stock roller conveyor 70 at a downstream side in the transportation direction of the stock roller conveyor 70. The loading-side delivery roller conveyor 74 functions as a loading-side delivery unit. The loading-side delivery roller conveyor 74 is set on an extension line in the transportation direction of the stock roller conveyor 70, and an arrangement direction of the plurality of conveyor rollers is the same direction as an arrangement direction of the conveyor rollers of the stock roller conveyor 70. The loading-side delivery roller conveyor 74 can place the trays T in the state of stacked in the plurality of stages.

A transportation roller conveyor 76 is disposed in the vicinity of the loading-side delivery roller conveyor 74 at a device left side of the loading-side delivery roller conveyor 74. A portion of the upstream side in the transportation direction of the transportation roller conveyor 76 is in the vicinity of the loading-side delivery roller conveyor 74. The transportation roller conveyor 76 functions as a transportation conveyor. A safety fence 77 is installed at the front surface side of the device with respect to the transportation roller conveyor 76. The transportation roller conveyor 76 is disposed in a range including the device front side of the cabinet 12 in a direction perpendicular to the extension direction of the stock roller conveyor 70 (i.e., the device leftward/rightward direction), and a direction from the device right side toward the device left side is set as the transportation direction (an arrow X2 direction). The transportation roller conveyor 76 has a plurality of conveyor rollers rotatably supported by conveyor base frames installed at both sides in the transportation width direction.

The plurality of conveyor rollers are arranged in the transportation direction (the arrow X2 direction), connected to the driving motor (not shown) via the driving force transmission mechanism, and configured to rotate by the driving force of the driving motor. Then, the transportation roller conveyor 76 transports the tray T using the rotational force of the conveyor roller.

A local manipulation box 72C is disposed at the device front side close to the downstream side in the transportation direction of the transportation roller conveyor 76, and the local manipulation box 72C is connected to the controller 64 (the connection state is not shown). In addition, the driving motor configured to drive the transportation roller conveyor 76 is connected to the controller 64, and an operation thereof is controlled by the controller 64 according to the manipulation information of the local manipulation box 72C.

An unloading-side delivery roller conveyor 78 is disposed in the vicinity of the transportation roller conveyor 76 at the downstream side in the transportation direction of the transportation roller conveyor 76. The unloading-side delivery roller conveyor 78 functions as an unloading-side delivery unit. A safety fence 79 is installed at the device back side of the unloading-side delivery roller conveyor 78. The unloading-side delivery roller conveyor 78 is set on the extension line in the transportation direction of the transportation roller conveyor 76, and the arrangement direction of a plurality of conveyor rollers thereof becomes a direction perpendicular to the arrangement direction of the conveyor rollers of the transportation roller conveyor 76. The unloading-side delivery roller conveyor 78 can place the trays T in the state of stacked in the plurality of stages.

An unloading roller conveyor 80 is disposed in the vicinity of the unloading-side delivery roller conveyor 78 at the device front side of the unloading-side delivery roller conveyor 78. A portion of the upstream side in the transportation direction of the unloading roller conveyor 80 is disposed in the vicinity of the unloading-side delivery roller conveyor 78. A safety fence 81 is installed at the device left side with respect to the unloading roller conveyor 80. The unloading roller conveyor 80 is set on the extension line of the unloading-side delivery roller conveyor 78, and a direction from the device back side toward the device front side (an arrow X3 direction) is set as the transportation direction. The unloading roller conveyor 80 has a plurality of conveyor rollers rotatably supported by the conveyor base frames installed at both sides in the transportation width direction. The plurality of conveyor rollers are arranged in the transportation direction (the arrow X3 direction), connected to the driving motor (not shown) via the driving force transmission mechanism, and configured to rotate by the driving force of the driving motor. Then, the unloading roller conveyor 80 can place the trays T in the state of stacked in the plurality of stages, and transports the trays T in the state of stacked in the plurality of stages.

An outlet manipulation panel 72D is disposed at the device right side at the most downstream side in the transportation direction of the unloading roller conveyor 80, and the outlet manipulation panel 72D is connected to the controller 64 (the connection state is not shown). The driving motor configured to drive the unloading roller conveyor 80 is connected to the controller 64, and an operation thereof is controlled by the controller 64 according to the manipulation information of the outlet manipulation panel 72D.

Further, in the embodiment, an interruption roller conveyor 82 is installed at an opposite side of the stock roller conveyor 70 (i.e., the device front side) with the loading-side delivery roller conveyor 74 shown by dot lines at the right side of FIG. 3 gripped therebetween. A safety fence 83 is installed at the device right side with respect to the interruption roller conveyor 82. The interruption roller conveyor 82 sets a direction from the device front side toward the device back side (an arrow X4 direction) as the transportation direction, and a plurality of conveyor rollers are rotatably supported by the conveyor base frames installed at both sides in the transportation width direction. The plurality of conveyor rollers are arranged in the transportation direction (the arrow X4 direction), connected to the driving motor (not shown), and configured to rotate by the driving force of the driving motor. Then, the interruption roller conveyor 82 can place the trays T in the state of stacked in the plurality of stages, and transport the trays T in the state of stacked in the plurality of stages.

An entrance manipulation panel 72B is disposed at the device right side at the most upstream side in the transportation direction of the interruption roller conveyor 82, and the entrance manipulation panel 72B is connected to the controller 64 (the connection state is not shown). In addition, the driving motor configured to drive the interruption roller conveyor 82 is connected to the controller 64, and an operation thereof is controlled by the controller 64 according to the manipulation information of the entrance manipulation panel 72B.

Further, as will be apparent from the description, all of the stock roller conveyor 70, the loading-side delivery roller conveyor 74, the transportation roller conveyor 76, the unloading-side delivery roller conveyor 78, the unloading roller conveyor 80 and the interruption roller conveyor 82 are installed outside the cabinet 12.

Meanwhile, as shown in FIGS. 1 and 3, a dispensing device 84 in the vicinity of the loading-side delivery roller conveyor 74 and the upstream side in the transportation direction of the transportation roller conveyor 76 is installed at the device right side. The dispensing device 84 is a device configured to sequentially transfer the trays T stacked in the plurality of stages in the loading-side delivery roller conveyor 74 from the tray of the upper stage side to place the trays T on the transportation roller conveyor 76.

As shown in FIGS. 1 and 3, the dispensing device 84 includes a device frame 84A. As shown in FIG. 3, horizontal members of the device frame 84A are disposed at the device front side, the device back side and the device right side with respect to the loading-side delivery roller conveyor 74 and the upstream side in the transportation direction of the transportation roller conveyor 76 when seen in a plan view of the device. Guide rails 84B extending in the device leftward/rightward direction are formed at the device frame 84A to correspond to the loading-side delivery roller conveyor 74 and the upstream side in the transportation direction of the transportation roller conveyor 76. The guide rails 84B are set to a height higher than the loading-side delivery roller conveyor 74 and the upstream side in the transportation direction of the transportation roller conveyor 76.

The dispensing device 84 includes a trolley 84C configured to travel along the guide rails 84B. As shown in FIGS. 1 and 3, a rod front end section of a cylinder 84D having the device leftward/rightward direction as an axial direction is fixed to the device right side of the trolley 84C. The cylinder 84D is attached to the device frame 84A and is a known air cylinder, and the trolley 84C travels in the device leftward/rightward direction as the rod of the cylinder 84D expands and contracts in the device leftward/rightward direction.

As shown in FIG. 1, the cylinder 84D is connected to an air supply source 84F via an air direction control mechanism (electromagnetic valve or the like) 84E, which is shown as a block, and the air direction control mechanism 84E is connected to the controller 64. The controller 64 controls a direction of the expansion and contraction of the rod of the cylinder 84D by controlling the air direction control mechanism 84E.

The dispensing device 84 includes a clamp 84G supported by the trolley 84C via an elevating mechanism unit 84H. The elevating mechanism unit 84H includes an elevating motor 84I, and a ball screw mechanism 84J configured to convert rotation of the elevating motor 84I into linear movement in the device upward/downward directions. An elevating shaft 84K configured to elevate in the device upward/downward directions while being non-rotatable about the shaft in the device upward/downward directions with the ball screw mechanism 84J extends in the device upward/downward directions, and the clamp 84G is attached to the lower end section. Accordingly, the elevating mechanism unit 84H is configured to elevate the clamp 84G according to forward rotation/reverse rotation of the elevating motor 84I. The elevating motor 84I is connected to the controller 64, and an operation thereof is controlled by the controller 64.

The clamp 84G disposed at the lower side of the trolley 84C includes a pair of gripping sections configured to grip the tray T, and also includes a rotary mechanism configured to rotate the gripping sections between a gripping position and a retracting position about a shaft in the device forward/rearward directions. A driving unit of the clamp 84G is connected to the controller 64, and an operation thereof is controlled by the controller 64.

Meanwhile, as shown in FIG. 3, a loading/unloading device 86 is installed at a side toward the elevating door 14 (i.e., outside the cabinet 12) in front of the cabinet 12 with the transportation roller conveyor 76 interposed therebetween. The loading/unloading device 86 includes a trolley 86A. The trolley 86A can travel along rails (not shown) extending in a direction perpendicular to the transportation direction of the transportation roller conveyor 76. Further, the rails are installed at beam sections of a device frame 86J.

As shown in FIGS. 2 and 3, a rod front end section of a driving cylinder 86B having the device forward/rearward directions as the axial direction is fixed to the trolley 86A. The driving cylinder 86B is attached to the device frame 86J and is a known air cylinder, and the trolley 86A is reciprocally moved between the transportation roller conveyor 76 side and the hanger unit 52 (see FIG. 2) side (travel in the device forward/rearward directions) as the rod of the driving cylinder 86B expands and contracts in the device forward/rearward directions.

As shown in FIG. 2, the driving cylinder 86B is connected to an air supply source 86D via an air direction control mechanism (electromagnetic valve or the like) 86C, which is shown as a block, and the air direction control mechanism 86C is connected to the controller 64. The controller 64 controls a direction of the expansion and contraction of the rod of the driving cylinder 86B by controlling the air direction control mechanism 86C.

The arms 86G are attached to the trolley 86A via elevating cylinders 86E and 86F serving as an elevating mechanism having the device upward/downward directions as the axial direction. The elevating cylinders 86E and 86F, which may be known air cylinders, are attached to the arms 86G respectively, and the rods of the elevating cylinders 86E and 86F elevate the arms 86G in the device upward/downward directions while being expanded and contracted in the device upward/downward directions.

The elevating cylinder 86E is connected to the air supply source 86D via an air direction control mechanism (electromagnetic valve) 86H which is shown as a block, and the elevating cylinder 86F is connected to the air supply source 86D via an air direction control mechanism (an electromagnetic valve or the like) 86I shown as a block. The air direction control mechanisms 86H and 86I are connected to the controller 64. The controller 64 controls a direction of expansion and contraction of the rod of the elevating cylinder 86E by controlling the air direction control mechanism 86H, and controls a direction of expansion and contraction of the rod of the elevating cylinder 86F by controlling the air direction control mechanism 86I.

The arms 86G are members configured to transfer the tray T between the transportation roller conveyor 76 side and the hanger unit 52 side, and upon non-operation, retract to a lower gap between the conveyor rollers of the transportation roller conveyor 76 (see two-dot chain lines of a lower side of FIG. 2). As shown in FIG. 4, the arms 86G are installed as a pair at left and right sides, can be inserted into the left and right sides of the connecting section 56 in the opening section of the frame section 54 of the hanger unit 52, and can place and convey the tray T on which the workpiece W is placed. A thickness t in an upward/downward directions of placing sections of the arms 86G in which the tray T is placed is set to be smaller than a distance L in the upward/downward directions between the placing surface of the tray T (the upper surface of the tray receiving section 56B) and the upper surface of the lower frame section 54B in the connecting section 56.

The loading/unloading device 86 shown in FIG. 3 is configured to load/unload the tray T with respect to the hanger unit 52 (see FIG. 4) as the arms 86G are advanced and withdrawn by an operation of the driving cylinder 86B. That is, the loading/unloading device 86 loads the tray T transferred by the dispensing device 84 and transported by the transportation roller conveyor 76 into the hanger unit 52 (see FIG. 4) in the cabinet 12, and unloads the tray T from the hanger unit 52 (see FIG. 4) in the cabinet 12 to be placed on the transportation roller conveyor 76. In other words, the transportation roller conveyor 76 is disposed to cross an operation region of the loading/unloading device 86.

In addition, as shown in FIGS. 1 and 3, a stacking device 88 in the vicinity of the downstream side in the transportation direction of the transportation roller conveyor 76 and the unloading-side delivery roller conveyor 78 is installed at the device left side. The stacking device 88 is in a standby state while the tray T unloaded by the loading/unloading device 86 and transported by the transportation roller conveyor 76 is gripped and raised, lowered to grip another tray T when the other tray T is transported immediately under the standby position, and further, causes the trays T to be placed on the unloading-side delivery roller conveyor 78 in a state in which the trays T are stacked in the plurality of stages.

As shown in FIGS. 1 and 3, the stacking device 88 includes a device frame 88A. As shown in FIG. 3, the horizontal members of the device frame 88A are disposed at the device front side, the device back side and the device left side with respect to the downstream side in the transportation direction of the transportation roller conveyor 76 and the unloading-side delivery roller conveyor 78 when seen in the plan view of the device. Guide rails 88B extending in the device leftward/rightward direction are installed at the device frame 88A to correspond to the downstream side in the transportation direction of the transportation roller conveyor 76 and the unloading-side delivery roller conveyor 78. The guide rails 88B are set to a height higher than the downstream side in the direction of the transportation roller conveyor 76 and the unloading-side delivery roller conveyor 78.

The stacking device 88 includes a trolley 88C configured to travel along the guide rails 88B. As shown in FIGS. 1 and 3, a rod front end section of a cylinder 88D having the device leftward/rightward direction as the axial direction is fixed to the device left side of the trolley 88C. The cylinder 88D is attached to the device frame 88A and is a known air cylinder, and as the rod of the cylinder 88D expands and contracts in the device leftward/rightward direction, the trolley 88C travels in the device leftward/rightward direction.

As shown in FIG. 1, the cylinder 88D is connected to an air supply source 88F via air direction control mechanism (electromagnetic valve or the like) 88E, which is shown as a block, and the air direction control mechanism 88E is connected to the controller 64. The controller 64 controls a direction of expansion and contraction of the rod of the cylinder 88D by controlling the air direction control mechanism 88E.

The stacking device 88 includes a clamp 90 supported by the trolley 88C via an elevating unit 88H. The elevating unit 88H includes an elevating motor 88I and a ball screw mechanism 88J configured to convert rotation of the elevating motor 88I into linear movement in the device upward/downward directions. An elevating shaft 88K configured to elevate in the device upward/downward directions with being non-rotatable about the shaft in the device upward/downward directions while the ball screw mechanism 88J extends in the device upward/downward directions, and the clamp 90 is attached to the lower end section. Accordingly, the elevating unit 88H is configured to elevate the clamp 90 according to forward rotation/reverse rotation of the elevating motor 88I. The elevating motor 88I is connected to the controller 64, and an operation thereof is controlled by the controller 64.

Figure 5:
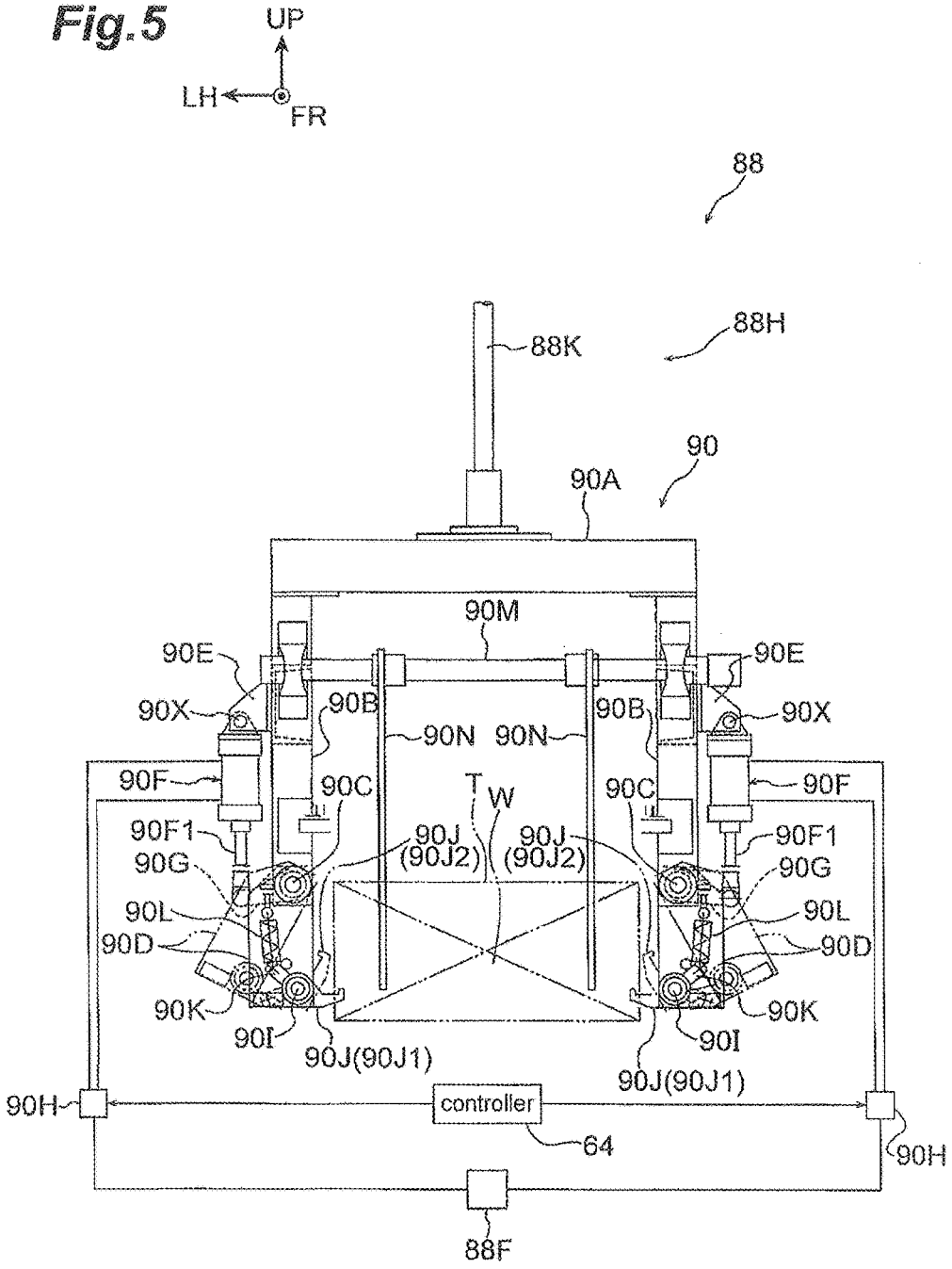
FIG. 5 is an enlarged front view of a clamp of a stacking device of FIG. 1.

The clamp 90 used to grip the tray T is disposed at a lower side of the trolley 88C. FIG. 5 is an enlarged front view showing the clamp 90 of the stacking device 88. As shown in FIG. 5, the clamp 90 includes a base member 90A to which the lower end section of the elevating shaft 88K is attached. The base member 90A is disposed such that a horizontal direction (in the embodiment, the device leftward/rightward direction) becomes a longitudinal direction, and the elevating shaft 88K is attached to a central section in the longitudinal direction.

A pair of fixed arm sections 90B fixed to the base member 90A in a cantilevered state and parallel to each other are installed at both end sections of the base member 90A. A support shaft 90C having a horizontal direction perpendicular to opposite directions (in the embodiment, the device forward/rearward directions) as an axial direction is rotatably installed at front end sections of the pair of fixed arm sections 90B. A base end section of a movable arm section 90D is fixed to the support shaft 90C. That is, the movable arm section 90D is attached to the front end section of the fixed arm section 90B via the support shaft 90C in a cantilevered state.

In addition, a cylinder 90F is rotatably attached to a surface (an outer surface) opposite to facing surfaces of an upper section of the pair of fixed arm sections 90B (an area close to the base member 90A) around a shaft 90X parallel to the support shaft 90C via a bracket 90E. The cylinder 90F is a known air cylinder, and a rod 90F1 protruding toward an opposite side of the bracket 90E with respect to the cylinder 90F expands and contracts generally in the device upward/downward directions. The front end section of the rod 90F1 and the support shaft 90C installed at the front end section of the fixed arm section 90B are connected by a connecting member 90G. Accordingly, the support shaft 90C is rotated by a predetermined angle around the axis thereof as the rod 90F1 expands and contracts, and thus, the movable arm section 90D is rotated according to thereto.

The cylinder 90F is connected to the air supply source 88F via air direction control mechanisms (electromagnetic valves or the like) 90H, which are shown as blocks, and the air direction control mechanism 90H is connected to the controller 64. The controller 64 controls a direction of expansion and contraction of the rod 90F1 of the cylinder 90F by controlling the air direction control mechanism 90H.

A rotary shaft 90I having a direction parallel to the support shaft 90C as an axial direction is rotatably held by the front end section of the movable arm section 90D. A base end section of a clamp jaw 90J is fixed to the rotary shaft 90I. That is, the clamp jaw 90J is attached to the front end section of the movable arm section 90D via the rotary shaft 90I in a cantilevered state. The front end section of the clamp jaw 90J is disposed between the pair of movable arm sections 90D when seen in a front view of the clamp 90. The clamp jaw 90J constituting a part of the clamp 90 is rotatable between a support posture 90J1 in which the clamp jaw 90J can support a bottom surface of the tray T and a retract posture 90J2 in which the clamp jaw 90J is rotated upward and retracted when coming in contact with a side surface of the tray T upon lowering around the axis of the rotary shaft 90I in the horizontal direction.

In addition, a spring attachment arm 90K is fixed to the rotary shaft 90I. The spring attachment arm 90K extends toward an opposite side of the clamp jaw 90J, and one end of a tensile coil spring 90L (an element recognized as "a return spring" in the broad sense) serving as a biasing mechanism is attached to the front end section. The other end of the tensile coil spring 90L is attached to the base end side of the movable arm section 90D. The tensile coil spring 90L constituting a part of the clamp 90 biases the clamp jaw 90J in a direction from a rotational angle position of the retract posture 90J2 toward a rotational angle position of the support posture 90J1.

In addition, a connecting bar 90M configured to connect the pair of fixed arm sections 90B in a horizontal direction is installed at the base end section sides (the upper sections) of the pair of fixed arm sections 90B at the front surface side of the device and the rear surface side of the device. A pair of left and right shafts 90N is attached to an intermediate section in the longitudinal direction of the connecting bar 90M. The pair of left and right shafts 90N is hanging at a lower side of the device, and the lower section restricts positional deviation of the tray T.

Figure 6:
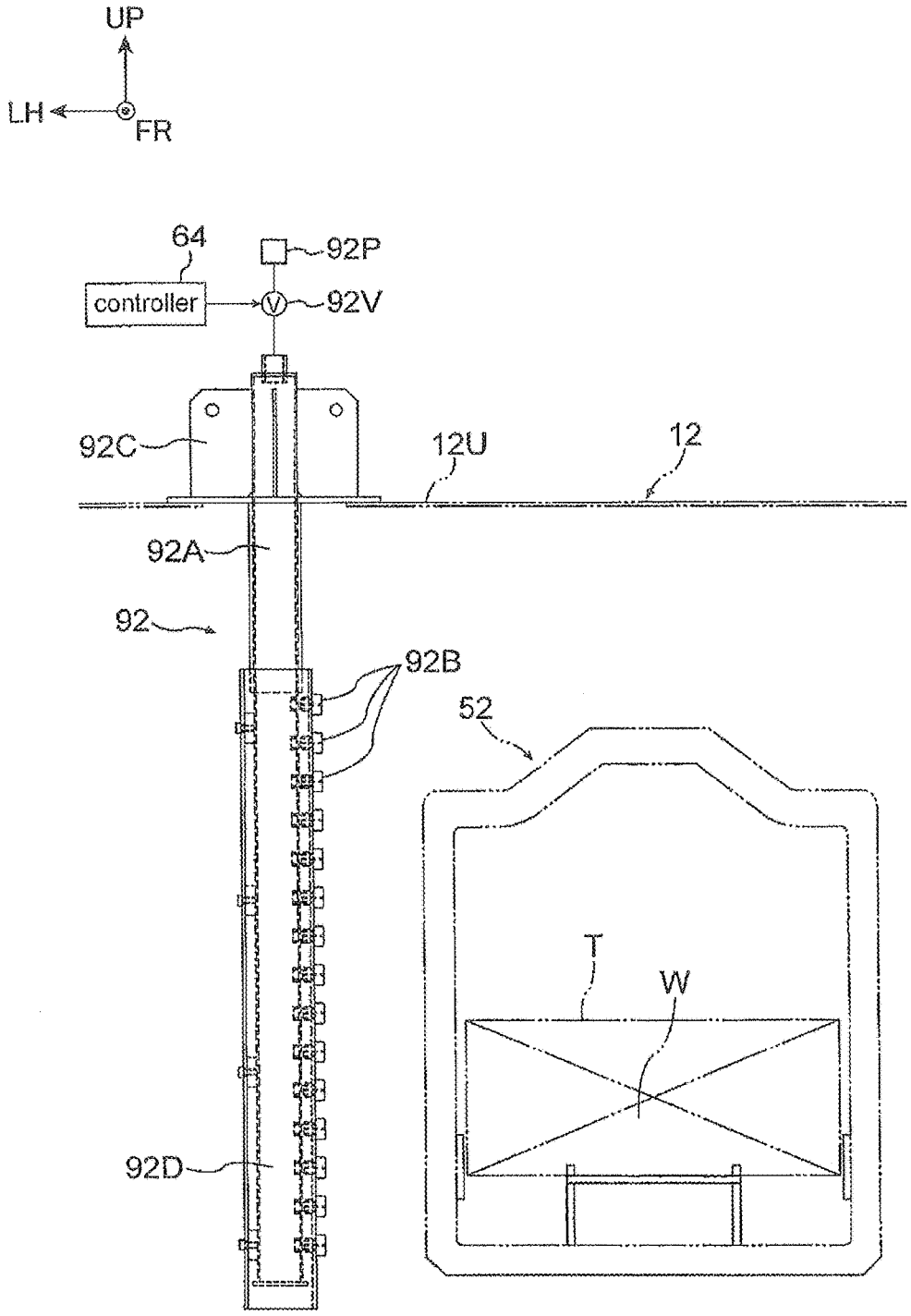
FIG. 6 is a side view showing a spraying device in a cabinet.

Meanwhile, a spraying device 92 shown in FIG. 6 is installed in the cabinet 12 shown in FIGS. 1 to 3. The spraying device 92 is a device that can spray a gas toward the hanger unit 52 in the cabinet 12 and configured to blow off the shot media remaining on the tray T and the workpiece W. The spraying device 92 includes an air flow pipe 92A. The air flow pipe 92A is connected to a pressurized air supply unit 92P via a valve 92V schematically illustrated in the drawing. The valve 92V is connected to the controller 64, and an opening/closing control thereof is performed by the controller 64. The air flow pipe 92A passes through the ceiling section 12U of the cabinet 12, and is fixed to the ceiling section 12U of the cabinet 12 via a fixing bracket 92C. The air flow pipe 92A is suspended in the cabinet 12, and a plurality of nozzles 92B are formed at an area thereof opposite to the hanger unit 52. Further, upon the gas spraying from the nozzle 92B, the hanger unit 52 is rotated around the axis in the device upward/downward directions according to the operation of the autorotation mechanism 62 (see FIG. 2).

The air flow pipe 92A and the nozzle 92B are disposed at positions deviated from a projection zone with which the shot media projected from the projection machines 22 and 24 can directly come in contact (see FIG. 2). A liner 92D is attached to an outer circumferential section of the air flow pipe 92A in the cabinet 12. The liner 92D is configured to protect the air flow pipe 92A and the nozzle 92B from abrasion due to a contact of the reflected shot media with the air flow pipe 92A or the nozzle 92B.

(Flow and Action/effect of Processing)

Next, an action and an effect of the embodiment will be described while summarizing a flow of the processing using the shot blasting device 10 shown in FIGS. 1 to 3. Further, while operations of the mechanisms are controlled by controller 64, in the following description, description of the control by the controller 64 will be appropriately omitted.

First, the trays T stacked in two stages are placed on the stock roller conveyor 70 as shown in FIG. 3 by an operator or a robot arm. The stock roller conveyor 70 transports the trays T stacked in the two stages toward the loading-side delivery roller conveyor 74.

When the trays T stacked in the two stages are placed on the loading-side delivery roller conveyor 74, the controller 64 shown in FIG. 1 controls the air direction control mechanism 84E, the driving unit of the clamp 84G, the elevating motor 84I, and the driving motor of the transportation roller conveyor 76 such that the dispensing device 84 and the transportation roller conveyor 76 are operated as described below.

The dispensing device 84 sequentially transfers the trays T stacked in the two stages on the loading-side delivery roller conveyor 74 starting with the tray T of the upper stage side and places the trays T on the transportation roller conveyor 76. More specifically, first, the elevating mechanism unit 84H moves and stops the clamp 84G to a position at which only an upper stage tray of the trays T stacked in the two stages on the loading-side delivery roller conveyor 74 can be gripped. Next, the clamp 84G grips only the upper stage tray. Then, the trolley 84C moves the clamp 84G to an upper side of the most upstream section in the transportation direction of the transportation roller conveyor 76. Next, the elevating mechanism unit 84H lowers the clamp 84G until the tray T comes in contact with the transportation roller conveyor 76, and then, the clamp 84G is opened. The transportation roller conveyor 76 moves the tray T to the elevating door 14 in front of the cabinet 12 and stops the tray T. Meanwhile, after the elevating mechanism unit 84H raises the clamp 84G the trolley 84C moves the clamp 84G to an upper side of the loading-side delivery roller conveyor 74.

Next, the elevating mechanism unit 84H moves the clamp 84G to a position at which the tray T (a lower stage tray) on the loading-side delivery roller conveyor 74 can be gripped, and stops the clamp 84G. Next, the clamp 84G grips the tray T (the lower stage tray). Then, the trolley 84C moves the clamp 84G to an upper side of the most upstream section in the transportation direction of the transportation roller conveyor 76. Next, the elevating mechanism unit 84H lowers the clamp 84G to a position at which the tray T comes in contact with the transportation roller conveyor 76, and then, the clamp 84G is opened. The transportation roller conveyor 76 moves the tray T to the elevating door 14 in front of the cabinet 12 and stops the tray T. Meanwhile, after the elevating mechanism unit 84H raises the clamp 84G, the trolley 84C moves the clamp 84G to an upper side of the loading-side delivery roller conveyor 74. That is, the clamp 84G returns to its original position.

Further, from transportation of the tray 'l' of the upper stage to transportation of the tray T of the lower stage, the transportation roller conveyor 76, the loading/unloading device 86 (see FIG. 3), the stacking device 88, and so on, are operated as described below.

When the transportation roller conveyor 76 shown in FIGS. 1 to 3 moves the tray T to the elevating door 14 in front of the cabinet 12 and stops the tray T, the controller 64 controls the air direction control mechanisms 86C, 86H and 86I, air direction control mechanisms (not shown) of the cylinder 16 and the door pressing cylinder 17, the travel driving motor 60, the autorotation driving motor 62A, the flow rate controller 46, the driving motors of the projection machines 22 and 24, and the valve 92V (see FIG. 6) such that the loading/unloading device 86, the elevating door 14, the trolley 58, the autorotation mechanism 62, the projection machines 22 and 24, and the spraying device 92 (see FIG. 6) are operated as described below.

First, the arms 86G are stopped after raising to a loading height position of the cabinet 12 while the arms 86G place the tray T with an operation of the elevating cylinder 86E shown in FIG. 2, and the elevating door 14 is raised and opened. Next, as the trolley 86A advances with the operation of the driving cylinder 86B, the arms 86G are inserted into the opening section of the frame section 54 of the hanger unit 52 in the cabinet 12.

Here, the pair of arms 86G shown in FIG. 4 is inserted into left and right sides of the connecting section 56 in the opening section of the frame section 54. Here, in the embodiment, the thickness t in the upward/downward directions of the placing section on which the tray T in the arms 86G is placed is set to be smaller than the distance L in the upward/downward directions between the placing surface of the tray T and the upper surface of the lower frame section 54B in the connecting section 56 of the hanger unit 52. For this reason, after the arms 86G on which the tray T is placed are inserted into the left and right sides of the connecting section 56 in the opening section of the frame section 54, when the elevating cylinder 86F (see FIG. 2) lowers the arms 86G, the tray T can be placed on the connecting section 56 of the hanger unit 52, and then, only the arms 86G can be withdrawn. That is, the tray T can be stably loaded into the hanger unit 52 while providing a simple configuration.

In addition, in the embodiment, an initial setting position at which the opening section of the frame section 54 of the hanger unit 52 in the rotational angle position around the axis in the device upward/downward directions of the hanging section 50 shown in FIG. 2 is set to be directed toward the arms 86G is detected by the angle position detection unit 66. The controller 64 can control the operation of the autorotation mechanism 62 to stop the hanging section 50 at the initial setting position based on the detection result of the angle position detection unit 66. For this reason, when the tray T is loaded into/unloaded from the hanger unit 52, the arms 86G are easily inserted into the frame section 54 of the hanger unit 52.

Next, as the trolley 86A is withdrawn by the operation of the driving cylinder 86B shown in FIGS. 2 and 3, the arm 86G is withdrawn from the inside of the opening section of the frame section 54 of the hanger unit 52, and further, the inside of the cabinet 12. Further, after the elevating door 14 is lowered and closed, the four corner sides of the elevating door 14 in the closed state are pressed by the door pressing cylinder 17 (see FIG. 1), and the arms 86G are lowered to the lower side of the conveyor roller of the transportation roller conveyor 76 and then stopped by the operation of the elevating cylinder 86E.

Meanwhile, in a step in which the four corner sides of the elevating door 14 are pressed by the door pressing cylinder 17 (see FIG. 1), the trolley 58 travels from the device front side to the device back side, the autorotation mechanism 62 rotates the hanging section 50 around the axis in the device upward/downward directions, and the projection machines 22 and 24 projects the shot media toward the hanger unit 52 for a predetermined time. In addition, here, the trolley 58 is temporarily stopped at three places such that the hanger unit 52 is three-point stopped at a predetermined position in the projection zone (see two-dot chain line of FIG. 3). Accordingly, the entire circumference of the workpiece W placed on the tray T over the hanger unit 52 is processed through the shot blasting without an irregularity. In addition, in this way, since the tray T is loaded into/unloaded from the hanger unit 52 and the workpiece W on the tray T is processed through the shot blasting, even when a type of the workpiece W is varied, exchanging a jig (secondarily hooks the hanger) is not needed. Accordingly, as the exchanging time of the jig is removed, a processing time when a variety of workpieces are processed is reduced, and operation efficiency is improved.

Next, after the projection for the predetermined time, as the projection machines 22 and 24 are stopped to stop supply of the shot media from the flow rate controller 46, when the shot blast processing is terminated in the cabinet 12, the spraying device 92 shown in FIG. 6 sprays a gas toward the hanger unit 52. Accordingly, the shot media remaining on the tray T and the workpiece W is blown off. Accordingly, discharge of the shot media when the tray T and the workpiece W are unloaded from the cabinet 12 is prevented or effectively suppressed.

Next, pressing of the four corner sides of the elevating door 14 is released by the door pressing cylinder 17 shown in FIG. 1, the elevating door 14 is raised and opened, and the arms 86 are raised to the loading/unloading height position of the cabinet 12 and then stopped in a state in which none of the arms 86G is placed by the operation of the elevating cylinder 86E shown in FIGS. 2 and 3. Then, as the trolley 86A is advanced by the operation of the driving cylinder 86B, the arms 86G are loaded into the opening section of the frame section 54 (see FIG. 4) of the hanger unit 52 in the cabinet 12. Then, as the arms 86G are raised by the operation of the elevating cylinder 86F, the tray T is placed on the arms 86G. Next, as the trolley 86A is withdrawn by the operation of the driving cylinder 86B, the arms 86G on which the tray T is placed is withdrawn from the opening section of the frame section 54 (see FIG. 4) of the hanger unit 52, and further, from the inside of the cabinet 12. Further, as the arms 86G are lowered to a lower gap in the conveyor rollers of the transportation roller conveyor 76 by the operation of the elevating cylinder 86E, the tray T is placed again on the transportation roller conveyor 76, and the arms 86G stops at the predetermined position of the lower side of the conveyor rollers of the transportation roller conveyor 76.

When the tray T on which the workpiece W processed through the shot blasting is placed is returned to the transportation roller conveyor 76 again, the controller 64 controls the driving motor of the transportation roller conveyor 76, the air direction control mechanisms 88E and 90H (see FIG. 5), and the elevating motor 88I such that the transportation roller conveyor 76 and the stacking device 88 shown in FIGS. 1 and 3 are operated as described below.

First, the transportation roller conveyor 76 transports the tray T unloaded by the loading/unloading device 86 to the most downstream section in the transportation direction of the transportation roller conveyor 76 and stops the tray T. In the embodiment, the transportation roller conveyor 76 is set such that the downstream side in the transportation direction has a length about two times the upstream side in the transportation direction when seen from the loading/unloading position by the loading/unloading device 86. Then, the tray T unloaded by the loading/unloading device 86 is transported to the downstream side in the transportation direction at the same time when the transportation roller conveyor 76 transmits the tray T from the most upstream section in the transportation direction to the loading/unloading position by the loading/unloading device 86. For this reason, the tray T stops once between the loading/unloading position by the loading/unloading device 86 and the most downstream section in the transportation direction of the transportation roller conveyor 76, and as further transported, arrives at the most downstream section in the transportation direction of the transportation roller conveyor 76.

Next, the stacking device 88 is on standby while the tray T unloaded by the loading/unloading device 86 and transported by the transportation roller conveyor 76 is gripped and raised, is lowered to grip the tray T when the tray T originally disposed at the second stage is transported immediately under the standby position, and further, the tray T is placed on the unloading-side delivery roller conveyor 78 in a state in which the tray T are stacked in the two stages. Accordingly, the tray T is stacked in the same vertical relationship before being transferred by the dispensing device 84, and placed on the unloading-side delivery roller conveyor 78.

For this reason, for example, even though the trays T are not stacked when the vertical relationship is reversed before the tray T is unloaded due to distortion or the like, the tray T may serve as the processing target. Also, when the tray T passes through a heat treatment furnace or the like, while distortion deformation may occur in the tray T, in this case, when the vertical relationship is reversed, stacking error may occur. However, in the embodiment, as described above, since the vertical relationship of the trays T is not varied, generation of such a stacking error is prevented or effectively suppressed, and good transportation of the tray T becomes possible. Further, in the embodiment, even when a shape of the upper stage tray is different from a shape of the lower end tray, these trays can be applied as long as a combination that can stably stack the trays is provided.

More specifically describing the processing of the stacking device 88, first, when the tray T (the tray that is originally disposed at the upper stage) arrives at the most downstream section in the transportation direction of the transportation roller conveyor 76, as the elevating unit 88H is operated, the clamp 90 on standby at the upper side of the most downstream section in the transportation direction of the transportation roller conveyor 76 is lowered. Here, the clamp jaw 90J constituting a part of the clamp 90 shown in FIG. 5 is rotatable around the axis in the horizontal direction between the support posture 90J1 in which the clamp jaw 90J can support a bottom surface of the tray T and the retract posture 90J2 in which the clamp jaw 90J is rotated upward and retracted when coming in contact with the side surface of the tray T upon lowering. In addition, the tensile coil spring 90L biases the clamp jaw 90J in a direction from the rotational angle position of the retract posture 90J2 toward the rotational angle position of the support posture 90J1. For this reason, even when the tray T is transported immediately under the standby position and the clamp jaw 90J is lowered, the clamp jaw 90J can be retracted, and when the clamp jaw 90J is lowered beyond the side surface lower end of the tray T, the bottom surface of the tray T can be supported while the clamp jaw 90J is at a support position by a biasing force of the tensile coil spring 90L.

Next, the clamp 90 is raised as the elevating unit 88H shown in FIG. 1 is operated, and the clamp 90 is on standby at the upper side of the most downstream section in the transportation direction of the transportation roller conveyor 76 while gripping the tray T. When the transportation roller conveyor 76 transports another tray T (the tray that is originally disposed at the lower stage) to the most downstream section in the transportation direction of the transportation roller conveyor 76 and stops the tray T in this state, as the elevating unit 88H is operated, the clamp 90 on standby at the upper side of the most downstream section in the transportation direction of the transportation roller conveyor 76 is lowered. Accordingly, the tray T (the tray that is originally disposed at the upper stage) first processed through the shot blasting overlaps the tray T (the tray that is originally disposed at the lower stage) processed later through the shot blasting. In addition, the clamp jaw 90J shown in FIG. 5 is rotated upward and retracted in a step of coming in contact with the side surface of the tray T processed through the shot blasting later (i.e., the lower stage tray), and the clamp jaw 90J is disposed at the support position by the biasing force of the tensile coil spring 90L when lowered beyond the side surface lower end of the tray T.

Next, as the elevating unit 88H (see FIG. 1) is operated, the clamp jaw 90J supports the bottom surface of the tray T of the lower stage while rising. That is, the trays T stacked in the two stages are raised. Then, as the trolley 88C shown in FIGS. 1 and 3 travels to the device left side, the stacking device 88 transports the trays T stacked in the two stages to the upper side of the unloading-side delivery roller conveyor 78. Next, the elevating unit 88H lowers the clamp 90 to a position at which the tray T comes in contact with the unloading-side delivery roller conveyor 78. After that, as the movable arm section 90D (see FIG. 5) of the clamp 90 is opened, the trays T stacked in the two stages are placed on the unloading-side delivery roller conveyor 78. Then, the trays T are moved from the unloading-side delivery roller conveyor 78 shown in FIG. 3 to the unloading roller conveyor 80, and unloaded as being transported by the unloading roller conveyor 80. Meanwhile, the clamp 90 shown in FIG. 1 is returned to the standby position of the upper side of the most downstream section in the transportation direction of the transportation roller conveyor 76 as the trolley 88C travels to the device right side after the elevating unit 88H is operated to be raised.

As described above, according to the shot blasting device 10 of the embodiment, the processing time when a variety of workpieces W are processed can be reduced.

[Variant of First Embodiment]

Figure 7:
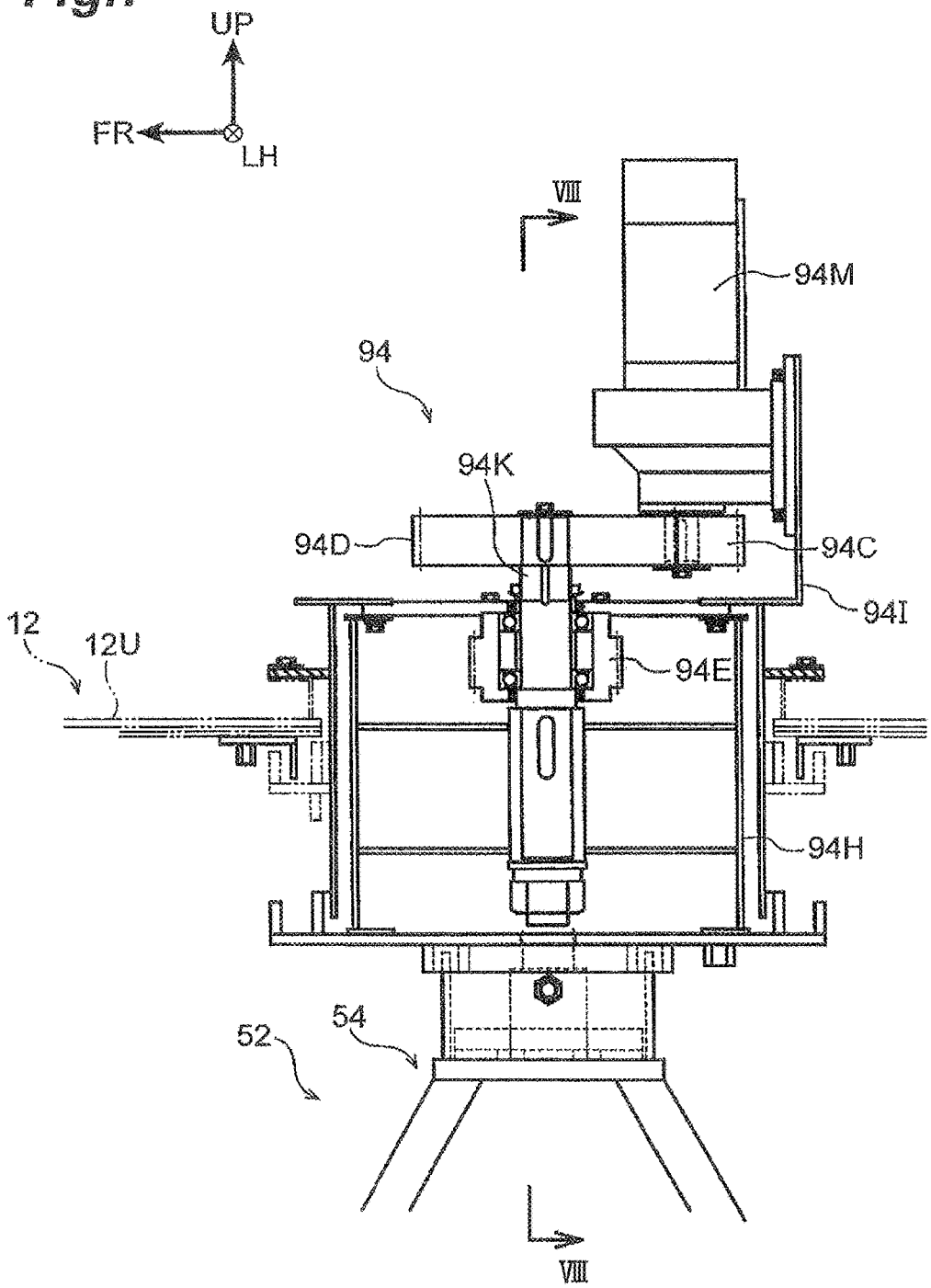
FIG. 7 is an enlarged view showing a hanger autorotation/revolution mechanism according to a modification of the first embodiment.
Figure 8:
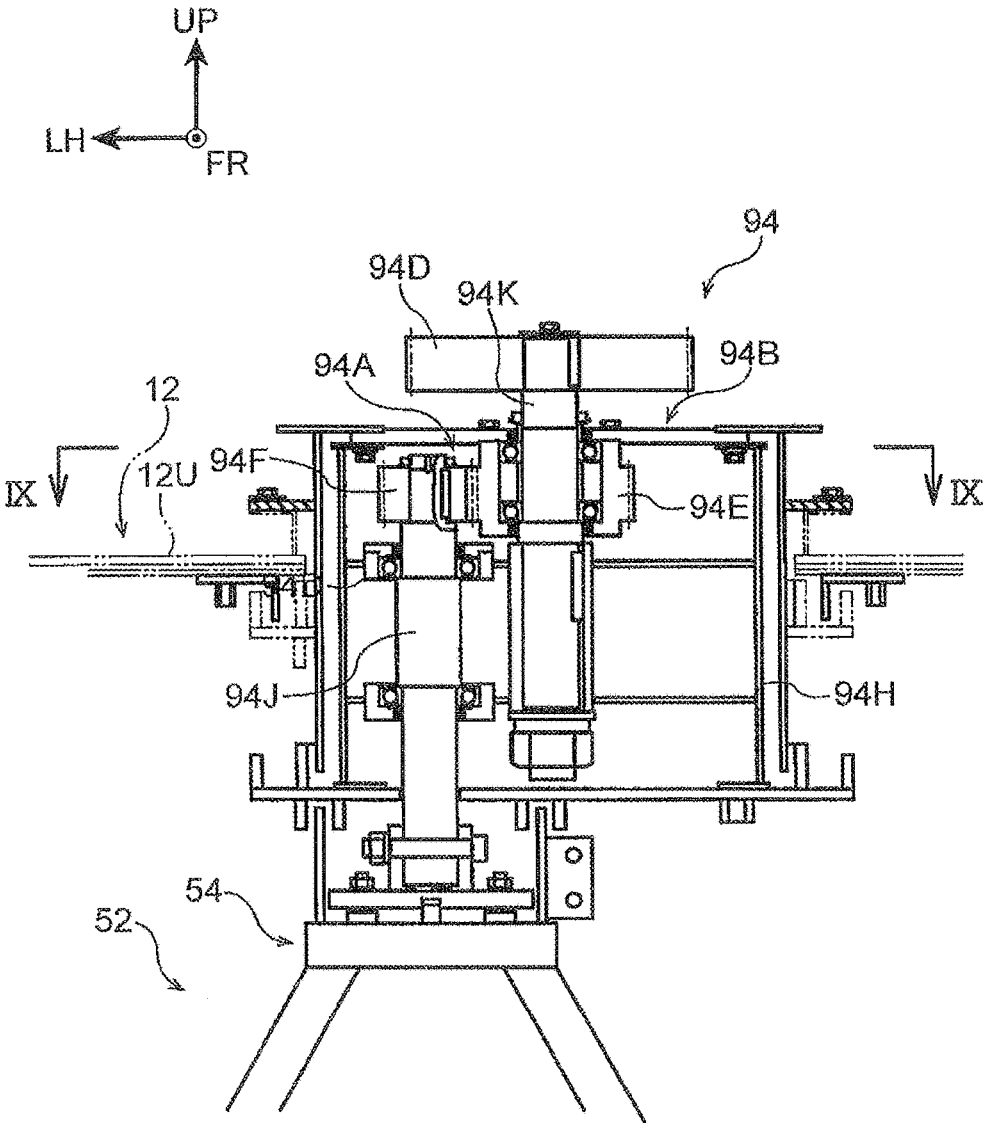
FIG. 8 is a view taken along line VIII-VIII of FIG. 7.
Figure 9:
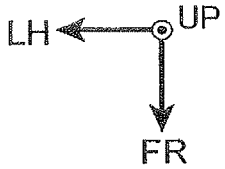
FIG. 9 is a view taken along line IX-IX of FIG. 8.
Figure 9:
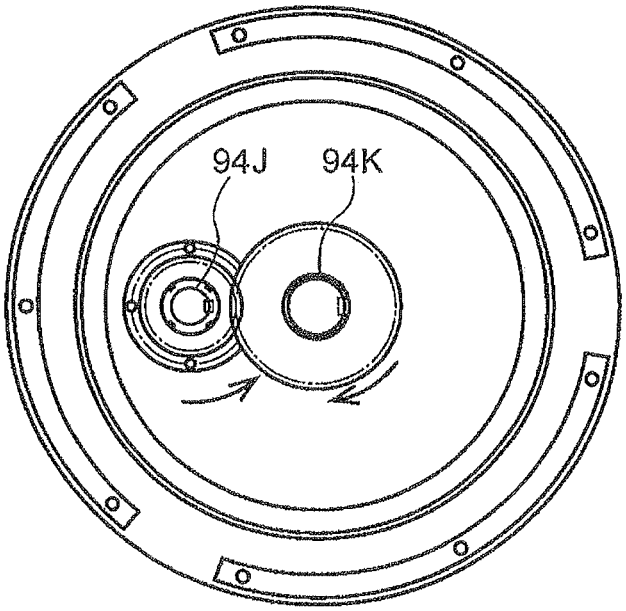

Next, a modification of the first embodiment will be described with reference to FIGS. 7 to 9. FIG. 7 is a side cross-sectional view showing a part of a ceiling section 12U of a cabinet 12 according to the modification of the first embodiment. In addition, FIG. 8 is a view taken along line VIII-VIII of FIG. 7, and FIG. 9 is a view taken along line IX-IX of FIG. 8. Substantially the same components as the first embodiment are designated by the same reference numerals, and description thereof will be omitted.

The modification of the first embodiment is different from the first embodiment in that, instead of the mechanism configured to displace the hanging section 50 shown in FIG. 2 in the device forward/rearward directions by the trolley 58, as shown in FIGS. 7 to 9, a mechanism configured to cause an autorotation shaft section 94J serving as an hanging section to revolve about a revolution shaft section 94K in the device upward/downward directions is installed. The other configurations are substantially the same as the first embodiment.

As shown in FIG. 8, an autorotation/revolution mechanism 94 configured to support both of an autorotation mechanism 94A configured to rotate the autorotation shaft section 94J around the axis of the autorotation shaft section 94J in the device upward/downward directions and a revolution mechanism 94B configured to rotate the autorotation shaft section 94J around the axis of the revolution shaft section 94K in the device upward/downward directions is installed at the ceiling section 12U of the cabinet 12. Further, as shown in FIG. 9, the autorotation shaft section 94J and the revolution shaft section 94K are set to offset positions when seen from a plan view of the device.

As shown in FIG. 7, the autorotation/revolution mechanism 94 includes a driving motor 94M for both of autorotation and revolution at an upper side of the ceiling section 12U of the cabinet 12. A revolution driving gear 94C is attached to an output shaft extending to the lower side of the device by the driving motor 94M. A revolution driven gear 94D is meshed with the revolution driving gear 94C. A diameter of the revolution driven gear 94D is set to be larger than a diameter of the revolution driving gear 94C. The revolution shaft section 94K is fixed to the central section of the revolution driven gear 94D.

A revolution drum 94H is disposed at a lower side of the revolution driven gear 94D at an outer circumferential side of the revolution shaft section 94K. The revolution drum 94H is set on the same axis as the revolution shaft section 94K, and attached to the revolution shaft section 94K. In addition, the revolution drum 94H is rotatably disposed around the axis of the revolution shaft section 94K with respect to the ceiling section 12U of the cabinet 12. The above-mentioned driving motor 94M is attached to the upper surface side of the revolution drum 94H via a bracket 94I.

As shown in FIG. 8, the autorotation shaft section 94J is disposed at a side of the revolution shaft section 94K in the revolution drum 94H. The autorotation shaft section 94J is rotatably supported around the axis of the autorotation shaft section 94J in the device upward/downward directions by the revolution drum 94H. The lower end section of the autorotation shaft section 94J is fixed to an upper section of the frame section 54 of the hanger unit 52.

Upon the operation of the driving motor 94M shown in FIG. 7, the driving force is transmitted sequentially to the revolution driving gear 94C, and the revolution driven gear 94D, the revolution shaft section 94K and the revolution drum 94H, which are shown in FIGS. 7 and 8. As a result, the autorotation shaft section 94J and the hanger unit 52 shown in FIG. 8 are revolved around the axis of the revolution shaft section 94K.

In addition, an autorotation driving gear 94E is installed at the outer circumferential side of the revolution shaft section 94K in the revolution drum 94H. The autorotation driving gear 94E is coaxially disposed at the revolution shaft section 94K and fixed to the upper end central section side of the revolution drum 94H. As shown in FIG. 8, an autorotation driven gear 94F is meshed with the autorotation driving gear 94E. The autorotation driven gear 94F is disposed at the upper end outer circumferential side of the autorotation shaft section 94J and coaxially fixed to the autorotation shaft section 94J.

Upon the operation of the driving motor 94M shown in FIG. 7, the driving force is transmitted sequentially to the revolution driving gear 94C, the revolution driven gear 94D, the revolution shaft section 94K, the revolution drum 94H and the autorotation driving gear 94E, which are shown in FIGS. 7 and 8, and the autorotation driven gear 94F and the autorotation shaft section 94J, which are shown in FIG. 8. As a result, the autorotation shaft section 94J and the hanger unit 52, which are shown in FIG. 8, are autorotated around the axis of the autorotation shaft section 94J.

According to such a modification, since the hanger unit 52 can be revolved while autorotating, a relative positional relation between the hanger unit 52 and the projection machines 22 and 24 (see FIG. 2) can be varied. As a result, the projected area in the workpiece W on the tray T placed on the hanger unit 52 is gradually offset, and the shot blast processing of the workpiece W is uniformly finished without an irregularity. In addition, in such a modification, since the hanger unit 52 can be autorotated and revolved by one driving motor 94M (see FIG. 7), the hanger unit 52 contributes to a compact structure and energy saving.

[Second Embodiment]

Next, a shot blasting device serving as a shot processing device according to a second embodiment of the present invention will be described with reference to FIGS. 10 to 20. Further, like the first embodiment, as appropriately shown in the drawings, an arrow FR represents a front side when seen in a front view of the device, an arrow UP represents an upper side of the device, and an arrow LH represents a left side when seen in the front view of the device.

Figure 10:
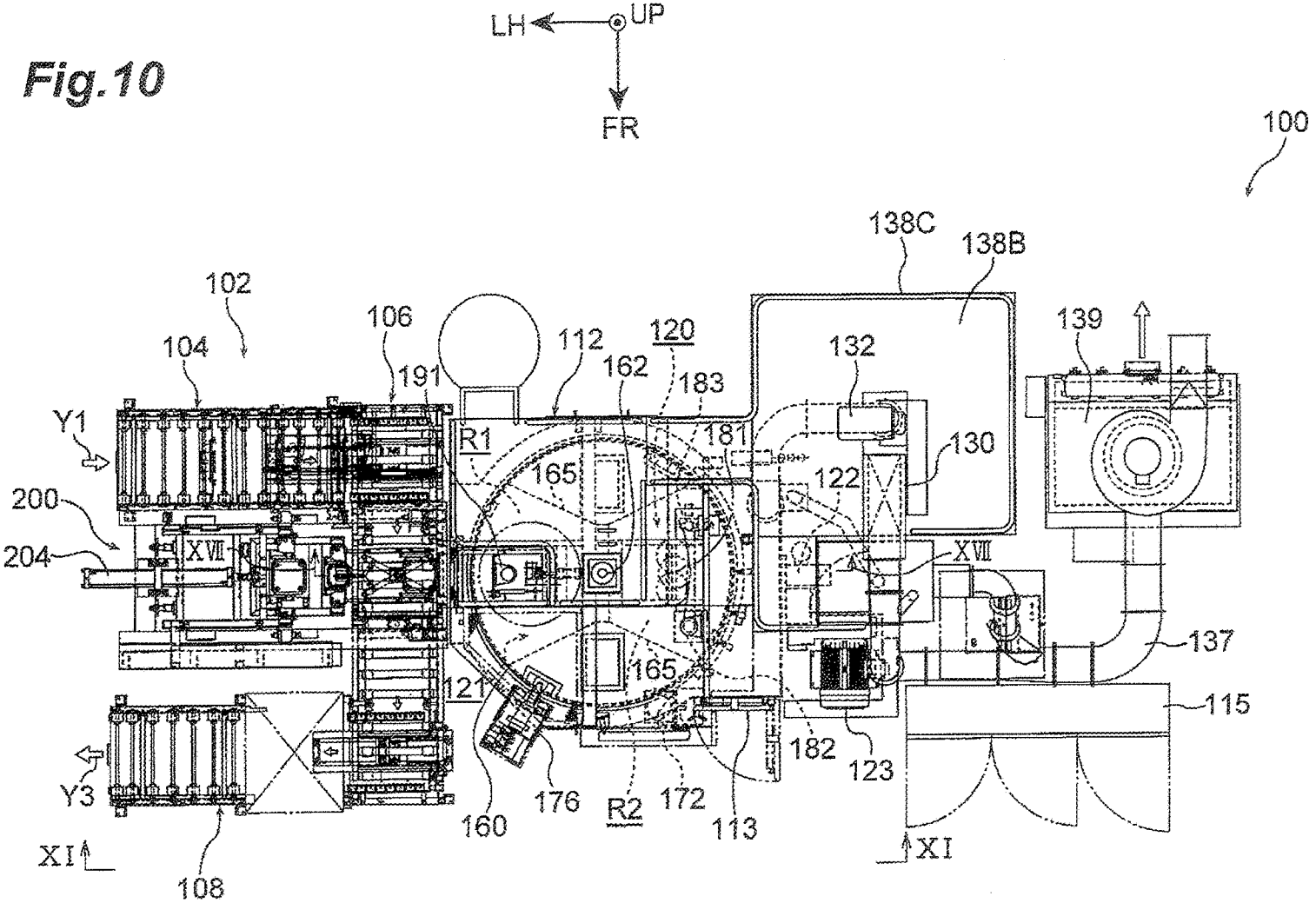
FIG. 10 is a plan view showing a shot blasting device according to a second embodiment.

FIG. 10 is a plan view showing the shot blasting device 100. In addition, FIG. 11 is a view (a front view) taken along line XI-XI of FIG. 10, and FIG. 12 is a view (a side cross-sectional view) taken along line XII-XII of FIG. 11.

Figure 11:
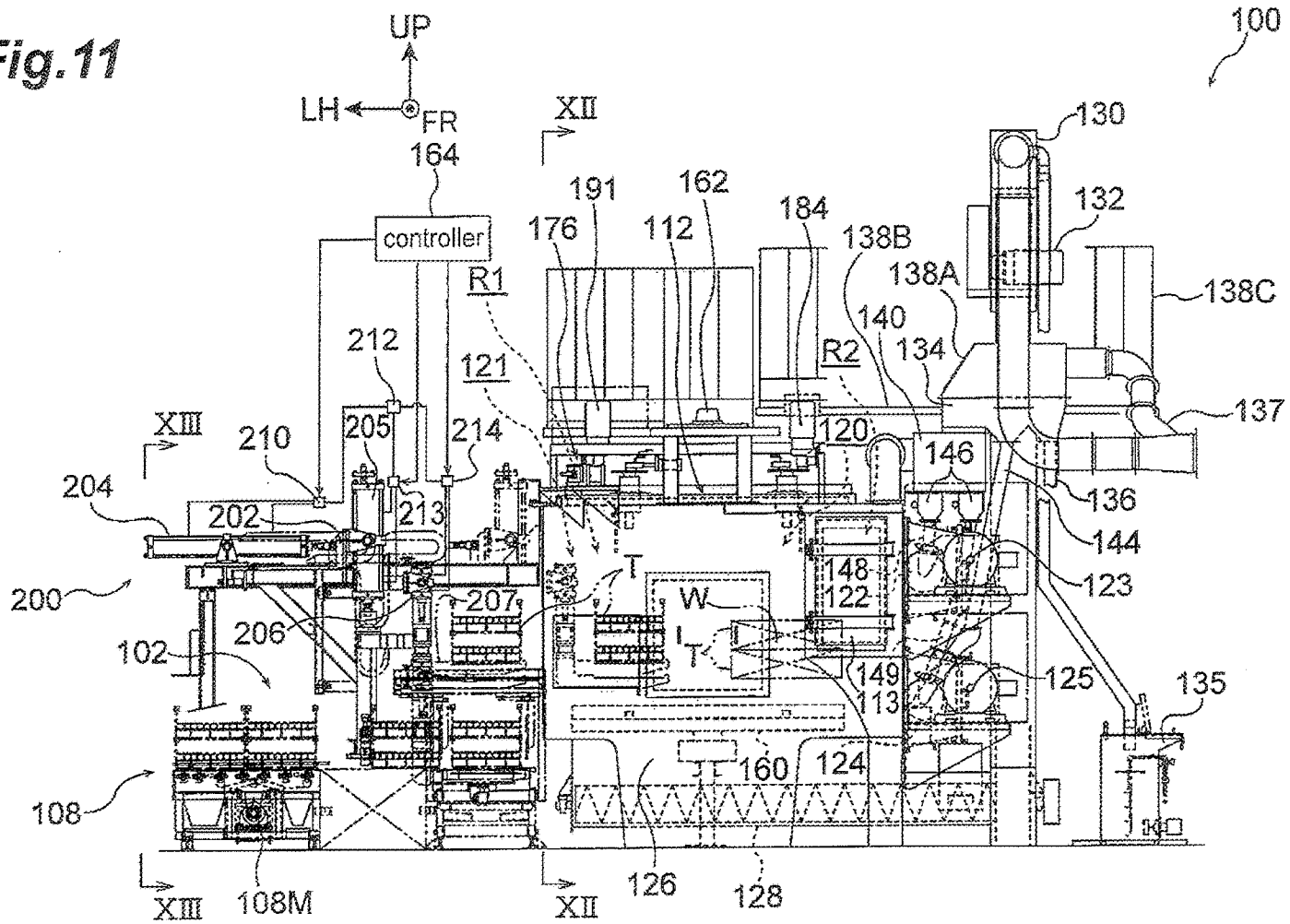
FIG. 11 is a view taken along line XI-XI of FIG. 10.
Figure 12:
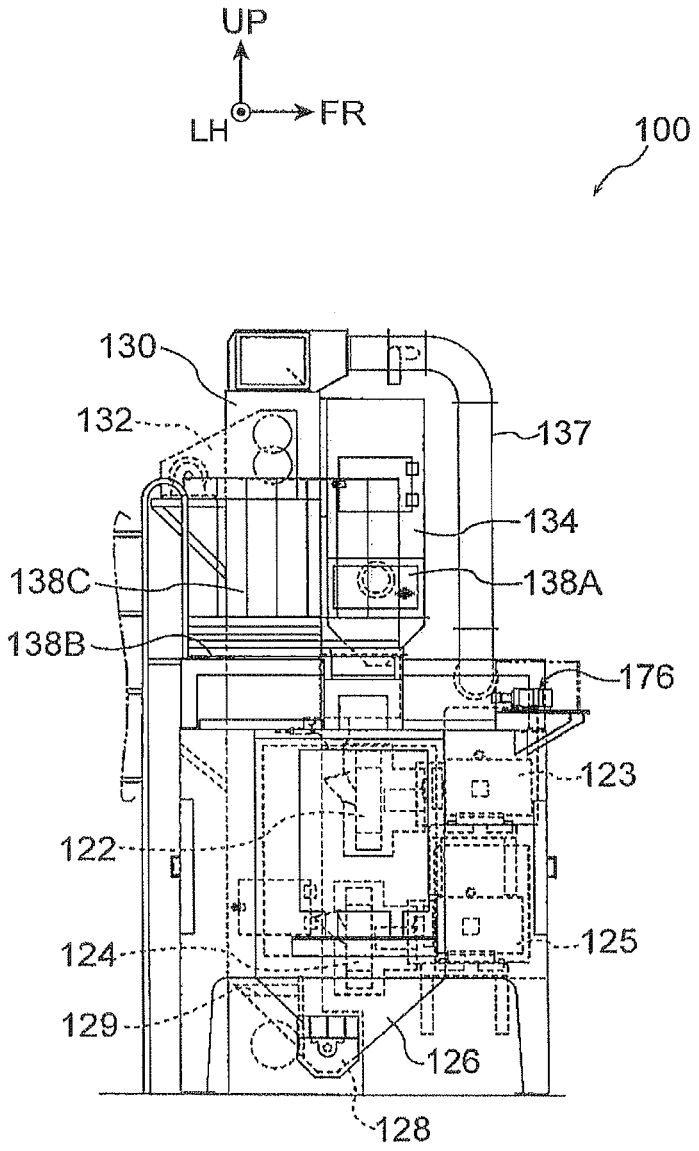
FIG. 12 is a view taken along line XII-XII of FIG. 11.

Like the first embodiment, the shot blasting device 100 shown in FIGS. 10 to 12 or the like transports the workpiece W placed on the tray T and performs the shot blast processing (removing burrs, scales, or the like, using the shot media). The tray T and the workpiece W, which are application targets, are also the same as the first embodiment.

(Summary of Inside of Cabinet and Peripheral Parts Thereof)

As shown in FIGS. 10 and 11, the shot blasting device 100 includes a cabinet 112 formed in a box shape. An inspection door 113 is installed at a right side of the front surface of the cabinet 112.

The projection chamber 120 in which surface processing (shot blast processing) of the workpiece W is performed by projection of the shot media to the workpiece W is formed at the device right side in the cabinet 112. The projection of the shot media to the workpiece W is performed by projection machines 122 and 124 shown in FIG. 11. The projection machines 122 and 124 are attached to sidewalls of the device right side of the cabinet 112 in pairs at upper and lower sides. Further, the projection machines 122 and 124 will be described below.

As shown in FIGS. 11 and 12, a shot media collecting hopper 126 is formed at a lower side of a projection chamber 120, and a screw conveyor 128 is disposed at a lower end side of a hopper 126. The screw conveyor 128 transports the shot media or the like collected by the hopper 126 to the device right side. Further, as shown in FIG. 12, a shot supply port 129 is formed in the vicinity of the device back side with respect to the screw conveyor 128. As shown in FIG. 11, the downstream side (the right side of FIG. 11) in the transportation direction of the screw conveyor 128 is disposed in the vicinity of a lower end section of a bucket elevator 130 extending in the device upward/downward directions. The bucket elevator 130 is driven by a driving motor 132 disposed in the vicinity of the upper section of the bucket elevator 130 to transport the collected shot media or the like to the upper side of the device.

An air-powered separator 134 is disposed in the vicinity of the upper end section of the bucket elevator 130, and the shot media or the like transported by the bucket elevator 130 is input into the separator 134. Further, a separator inspection door 138A for use with maintenance of the separator 134 is installed at the separator 134, and a platform 138B and a handrail 138C (see FIG. 10) are installed around the separator 134.

The separator 134 separates a usable shot media from other materials. A rough material discharge pipe 136 is connected to the separator 134. An unusable rough foreign substance separated by the separator 134 is discharged through the rough material discharge pipe 136. In addition, the separator 134 is connected to a dust collector 139 shown in FIG. 10 via a duct 137. Further, a control panel 115 is installed in front of the device with respect to the duct 137.

The unusable fine foreign substance separated by the separator 134 shown in FIG. 11 is suctioned into the dust collector 139 (see FIG. 10) via the duct 137 with air. The foreign substance suctioned into the dust collector 139 shown in FIG. 10 enters a dust receiver (not shown) in the lower section of the dust collector 139 as dust, whereas the air suctioned into the dust collector 139 is cleaned and exhausted. In addition, a precoat input device 135 is connected to the duct 137 shown in FIG. 11. In addition, the precoat input device 135 mixes inert powder with the dust, forms fireproofing dust and discharges the fireproofing dust to a dust receiver (not shown) in the lower section of the dust collector 139 shown in FIG. 10.

As shown in FIG. 11, a shot tank 140 configured to store the shot media is installed at the lower side of the separator 134. The usable shot media separated by the separator 134 enters the shot tank 140.

An overflow pipe 144 is installed in the vicinity of the upper opening of the shot tank 140. When the shot media input into the shot tank 140 is excessive, the excessive material is returned to the lower section in the cabinet 112 via the overflow pipe 144. A bottom section side of the shot tank 140 is connected to a flow rate controller 146. The flow rate controller 146 is a device configured to control supply of the shot media into the projection machines 122 and 124, and is connected to a controller 164 (the connection state is not shown). The controller 164 controls a supply amount of the shot media through the flow rate controller 146. Introduction pipes 148 and 149 are installed at the lower side of the flow rate controller 146, and the flow rate controller 146 is connected to the projection machines 122 and 124 via the introduction pipes 148 and 149. The introduction pipes 148 and 149 are pipes configured to supply the shot media into the projection machines 122 and 124.

(Configuration of Transportation Mechanism or the Like Outside Cabinet)

Figure 13:
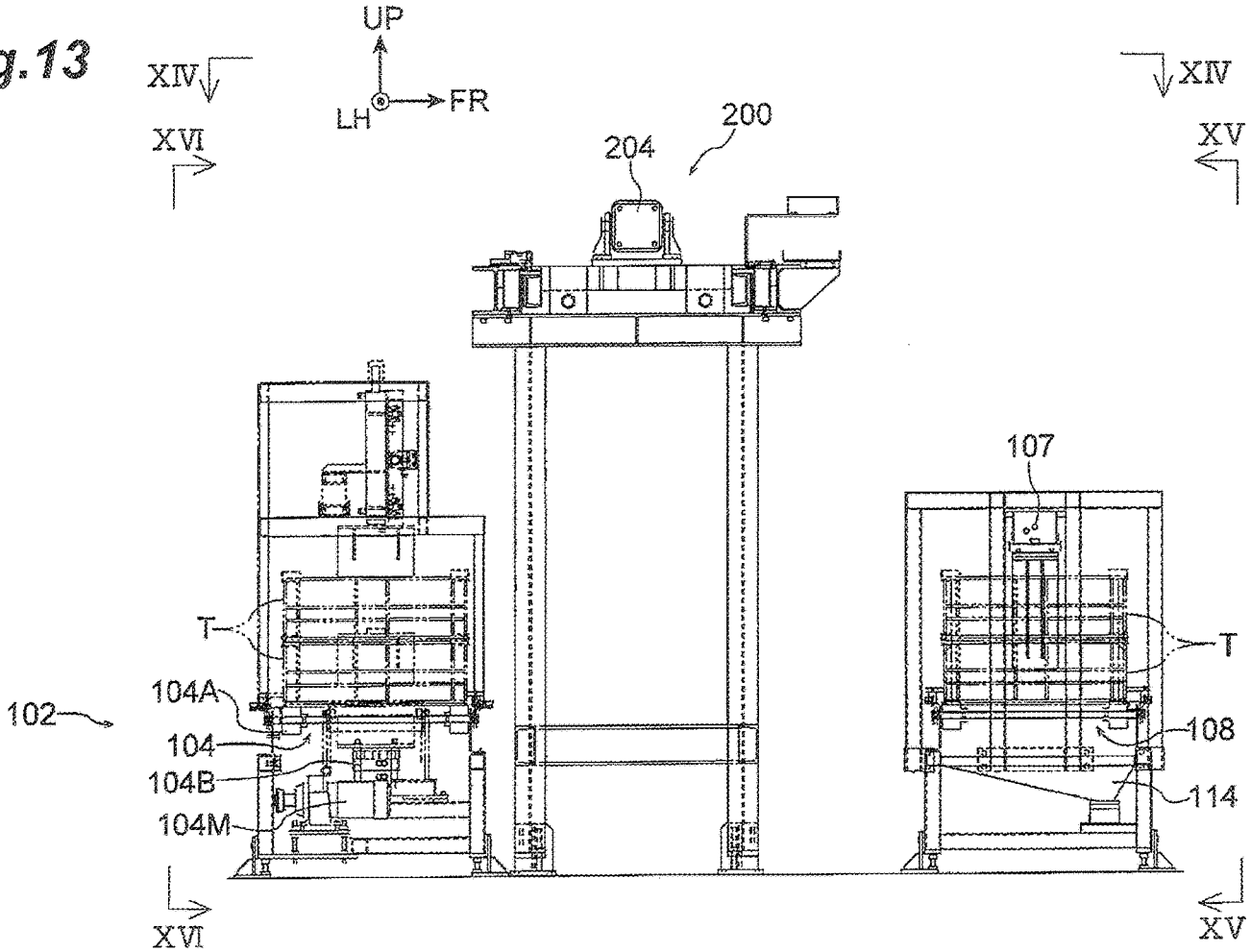
FIG. 13 is a view taken along line XIII-XIII of FIG. 11.
Figure 14:
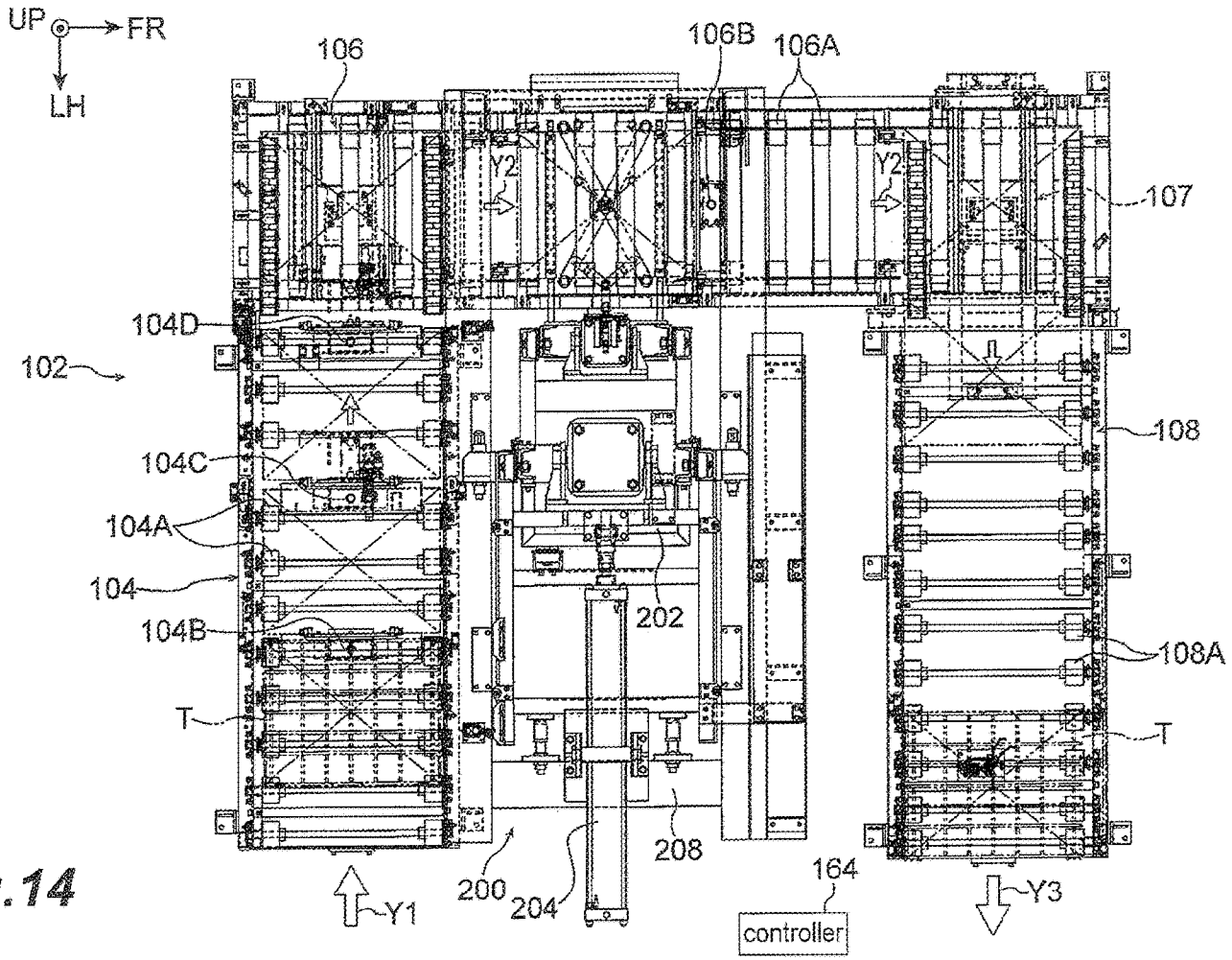
FIG. 14 is a view taken along line XIV-XIV of FIG. 13.
Figure 15:
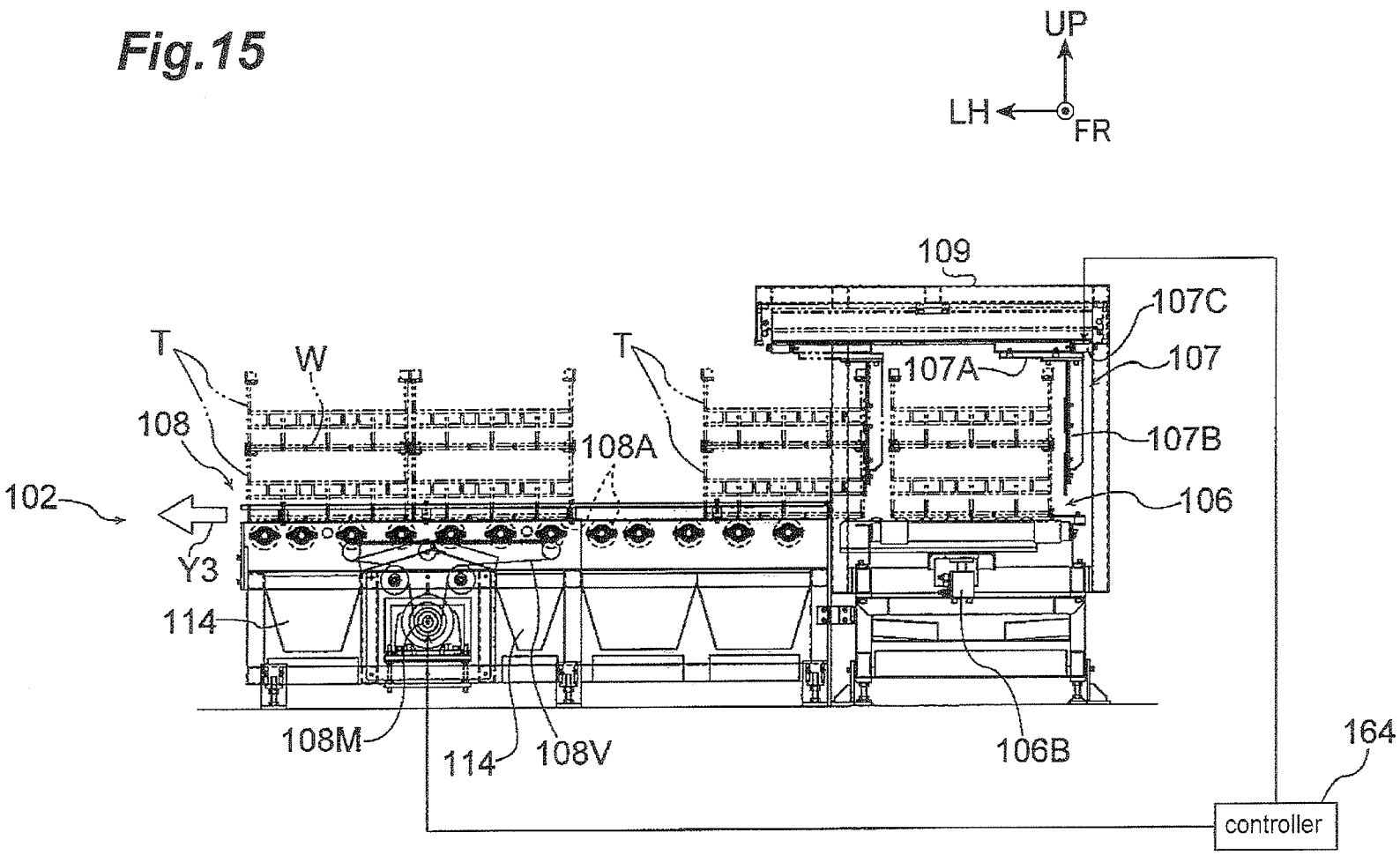
FIG. 15 is a view taken along line XV-XV of FIG. 13.
Figure 16:
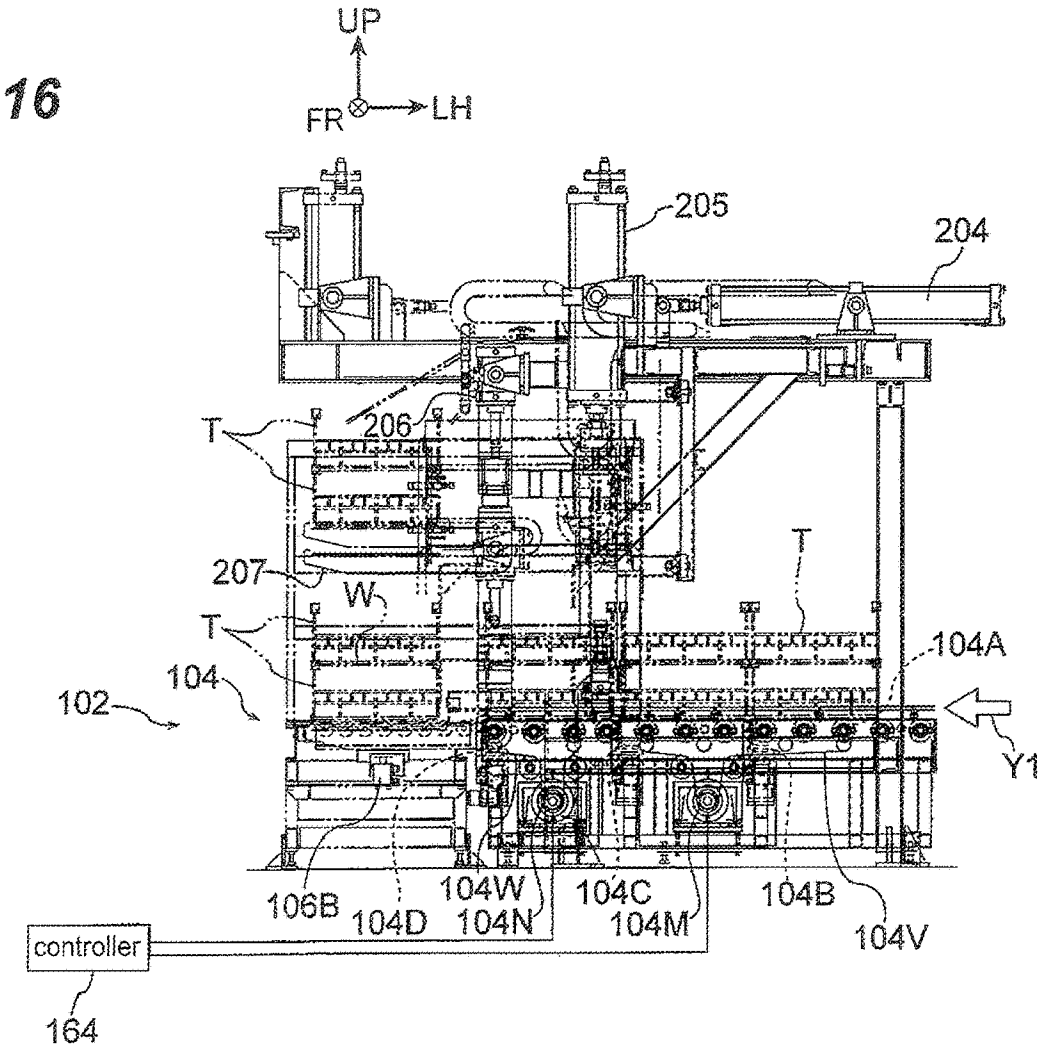
FIG. 16 is a view taken along line XVI-XVI of FIG. 13.

As shown in FIG. 10, a tray transportation device 102 is installed at the device left side (the outside) with respect to the cabinet 112. FIGS. 13 to 16 show the tray transportation device 102 or the like. FIG. 13 is a view taken along line XIII-XIII of FIG. 11 (a view seen from a left side surface of the device), FIG. 14 is a view taken along line XIV-XIV of FIG. 13 (a view when seen from a plan view of the device), FIG. 15 is a view taken along line XV-XV showing a side surface of an unloading-side of FIG. 13 (a view when seen from a front view of the device), and FIG. 16 is a view taken along line XVI-XVI showing a side surface of a loading-side of FIG. 13 (a view when seen from a rear view of the device).

As shown in FIGS. 13 and 14, the tray transportation device 102 includes a loading roller conveyor 104 installed at the device back side (a central side in FIGS. 13 and 14). As shown in FIG. 14, the loading roller conveyor 104 has a direction (an arrow Y1 direction) from the device left side toward the device right side as a transportation direction, and a plurality of conveyor rollers 104A are rotatably supported by conveyor base frames installed at both sides in the transportation width direction. The plurality of conveyor rollers 104A are arranged in the transportation direction (the arrow Y1 direction).

In addition, as shown in FIG. 16, the plurality of conveyor rollers 104A are connected to driving motors 104M and 104N via driving force transmission belts 104V and 104W, and are rotated by driving forces of the driving motors 104M and 104N. Then, the loading roller conveyor 104 can place the trays T on the plurality of stages in a stacked state, and transports the trays T in the state of stacked in the plurality of stages.

As shown in FIGS. 14 and 16, a plurality of (in the embodiment, three) stoppers 104B, 104C and 104D are installed at the lower side of the conveyor roller 104A in the arrangement direction of the conveyor roller 104A. The stoppers 104B, 104C and 104D are used for positioning of the transported trays T, and can protrude at positions higher than the conveyor roller 104A. The driving unit configured to drive the stoppers 104B, 104C and 104D, and the driving motors 104M and 104N shown in FIG. 16 are connected to the controller 164, and an operation thereof is controlled by the controller 164.

As shown in FIG. 14, an intermediate roller conveyor 106 is disposed in the vicinity of the downstream side in the transportation direction of the loading roller conveyor 104. The intermediate roller conveyor 106 has a direction (an arrow Y2 direction) from the device back side toward the device front side as a transportation direction, and the most upstream section in the transportation direction is set on an extension line in the transportation direction of the loading roller conveyor 104. In addition, as shown in FIG. 10, an area from an upstream section in the transportation direction of the intermediate roller conveyor 106 to an intermediate section in the transportation direction is disposed in the vicinity of the device left side of the cabinet 112. As shown in FIG. 14, the intermediate roller conveyor 106 includes a plurality of conveyor rollers 106A arranged in the transportation direction (the arrow Y2 direction). That is, the arrangement direction of the plurality of conveyor rollers 106A is set to a direction perpendicular to the arrangement direction of the conveyor rollers 104A of the loading roller conveyor 104. Then, the intermediate roller conveyor 106 can place the trays T in the state of stacked in the plurality of stages.

As shown in FIGS. 14 to 16, a stopper 106B is installed at the lower side of the conveyor roller 106A in the intermediate section in the transportation direction of the intermediate roller conveyor 106. The stopper 106B is used for positioning when the transported tray T is loaded into the cabinet 112 (see FIG. 10), and can protrude to the position of the upper side higher than the conveyor roller 106A. The driving unit configured to drive the stopper 106B is connected to the controller 164, and an operation thereof is controlled by the controller 164.

In addition, as shown in FIGS. 14 and 15, an unloading pusher 107 is installed at the upper side of the most downstream section in the transportation direction of the intermediate roller conveyor 106. As shown in FIG. 15, the unloading pusher 107 includes a slide section 107A supported by a ceiling frame 109 and slidable in the device leftward/rightward direction, and includes a pressing plate section 107B suspended from the end section of the right side of the slide section 107A. In addition, the slide section 107A is pressed from the device right side to the device left side by an actuator 107C that is expandable and contractible. Then, when the tray T is placed at the most downstream section in the transportation direction of the intermediate roller conveyor 106, as the slide section 107A slides from the device right side to the device left side, the pressing plate section 107B presses the tray T. In addition, the actuator 107C is connected to the controller 164, and an operation thereof is controlled by the controller 164.

As shown in FIG. 14, an unloading roller conveyor 108 is disposed in the vicinity of the right side in the transportation direction at the downstream side in the transportation direction of the intermediate roller conveyor 106. The unloading roller conveyor 108 has a direction (an arrow Y3 direction) from the device right side toward the device left side as a transportation direction, and is disposed parallel to the loading roller conveyor 104. A plurality of conveyor rollers 108A are rotatably supported by conveyor base frames installed at both sides in the transportation width direction. The plurality of conveyor rollers 108A are arranged in the transportation direction (the arrow Y3 direction). Further, in FIGS. 10 and 11, an area of the upstream side in the transportation direction of the unloading roller conveyor 108 is not shown.

In addition, as shown in FIG. 15, among the plurality of conveyor rollers 108A, the conveyor roller disposed at the downstream side in the transportation direction is connected to a driving motor 108M via a driving force transmission belt 108V, and is rotated by the driving force of the driving motor 108M. Then, the unloading roller conveyor 108 can place the trays T in the state of stacked in the plurality of stages, and transport the trays T in the state of stacked in the plurality of stages. In addition, a plurality of hoppers 114 are installed at the lower side of the conveyor roller 108A so as not to scatter the shot media that got on the tray T.

As shown in FIG. 14, a loading/unloading device 200 is disposed between the loading roller conveyor 104 and the unloading roller conveyor 108. As shown in FIG. 10, the loading/unloading device 200 is disposed to oppose the cabinet 112 with the intermediate roller conveyor 106 interposed therebetween. That is, the loading/unloading device 200 is disposed outside the cabinet 112. Then, the loading/unloading device 200 loads the tray T on the intermediate roller conveyor 106 (the workpiece W before the processing) into the cabinet 112, and unloads the tray T from the cabinet 112 (the workpiece W after the processing) to be placed onto the intermediate roller conveyor 106. A mechanism of the loading/unloading device 200 will be described below.

(Configuration of Rotary or the Like in Cabinet)

Meanwhile, a rotary (referred to as "a revolution drum") 160 having a substantially cylindrical shape and rotatably installed around an axis of a revolution shaft section 162 in the device upward/downward directions is disposed in the cabinet 112. The rotary 160 has a plurality of processing chambers R1 and R2 formed in parallel in the circumferential direction as a space around the axis of the revolution shaft section 162 is partitioned by partition sections 165. Opening sections opened toward an outer circumferential side and used for loading of the tray T, unloading of the tray T, and passage of the shot media are formed at the processing chambers R1 and R2.

Figure 17:
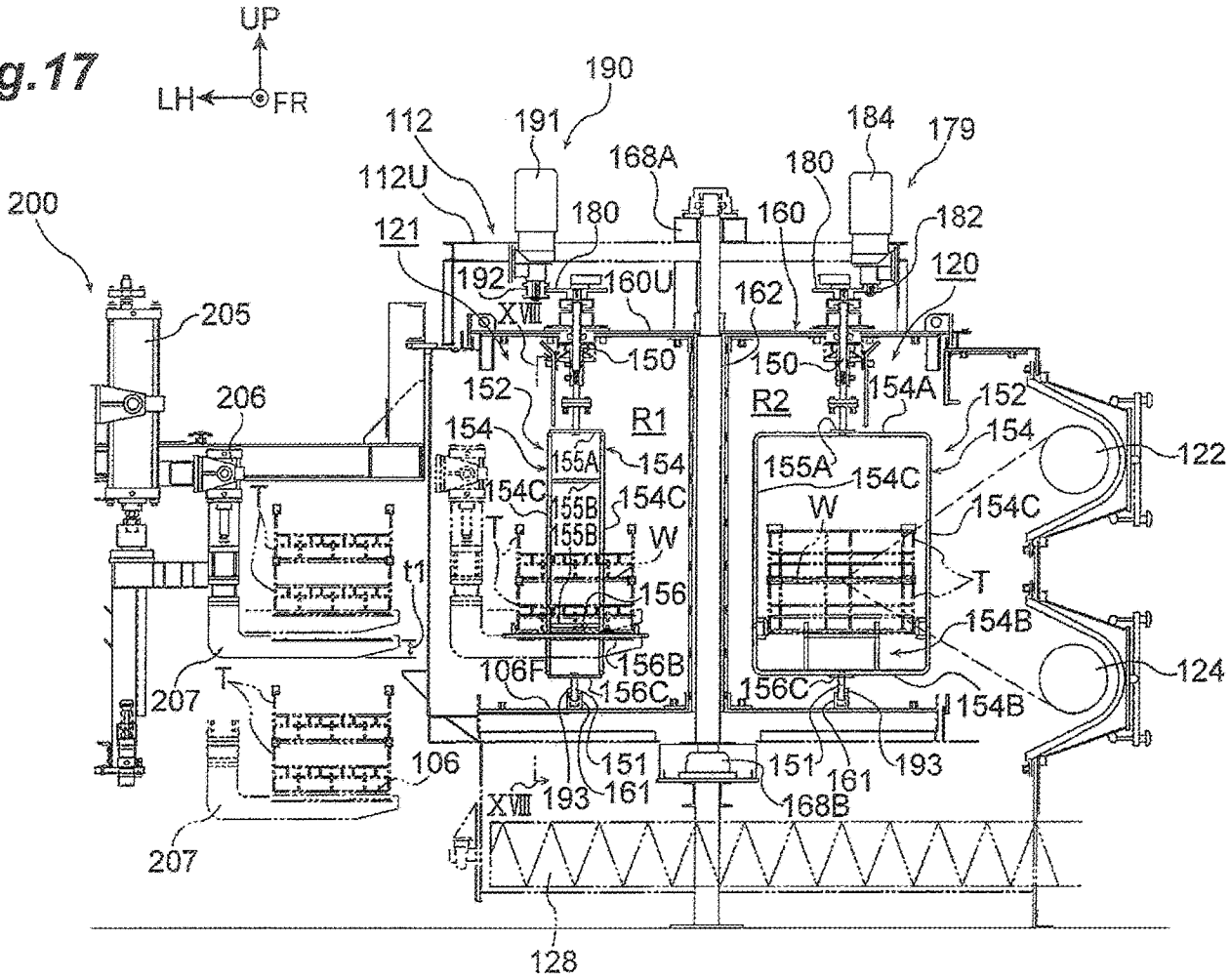
FIG. 17 is a view taken along line XVII-XVII of FIG. 10.

FIG. 17 is a view taken along line XVII-XVII in which the cabinet 112 in which the rotary 160 or the like is disposed and peripheral parts thereof are in a substantially central section of FIG. 10. As shown in FIG. 17, a ceiling section 160U of the rotary 160 is disposed at an upper side of the cabinet 112, and a hanging section 150 is formed at the ceiling section 160U of the rotary 160. The hanging section 150 has the device upward/downward directions as the axis direction, and is rotatably supported in the axial direction with respect to the ceiling section 160U of the rotary 160. In the hanging section 150, suspended portions suspended from the ceiling section 160U of the rotary 160 are installed in the processing chambers R1 and R2. Then, a hanger unit 152 (an element recognized also as "a tray receiver" or "a hanger hook") is suspended from the hanging section 150. Further, while the hanger unit 152 of the left side and the hanger unit 152 of the right side of FIG. 17 are formed in the same shape, since a rotational angle position of the autorotation in the hanger unit 152 is varied, in FIG. 17, different shapes are shown. The hanger units 152 are installed in the processing chambers R1 and R2 of the rotary 160 in the cabinet 112.

Figure 18:
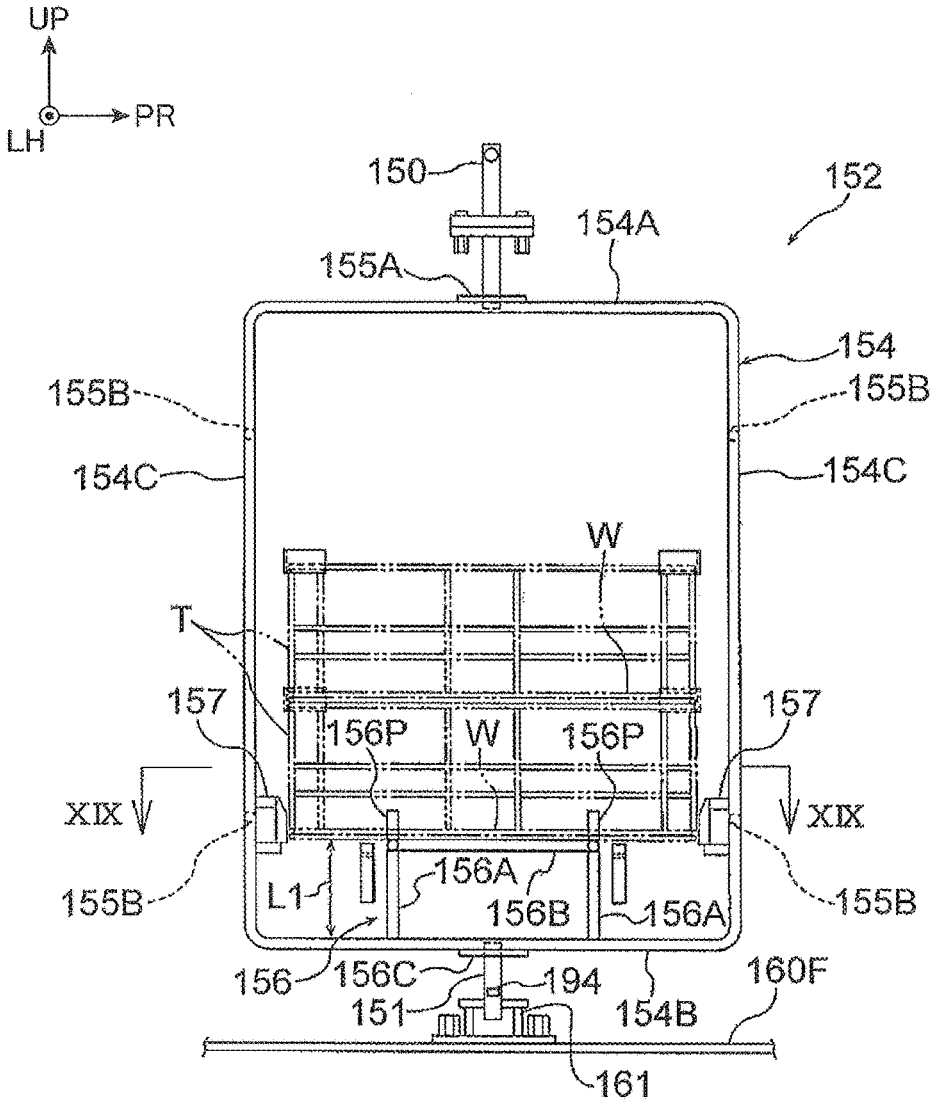
FIG. 18 is a view taken along line XVIII-XVIII of FIG. 17.
Figure 19:
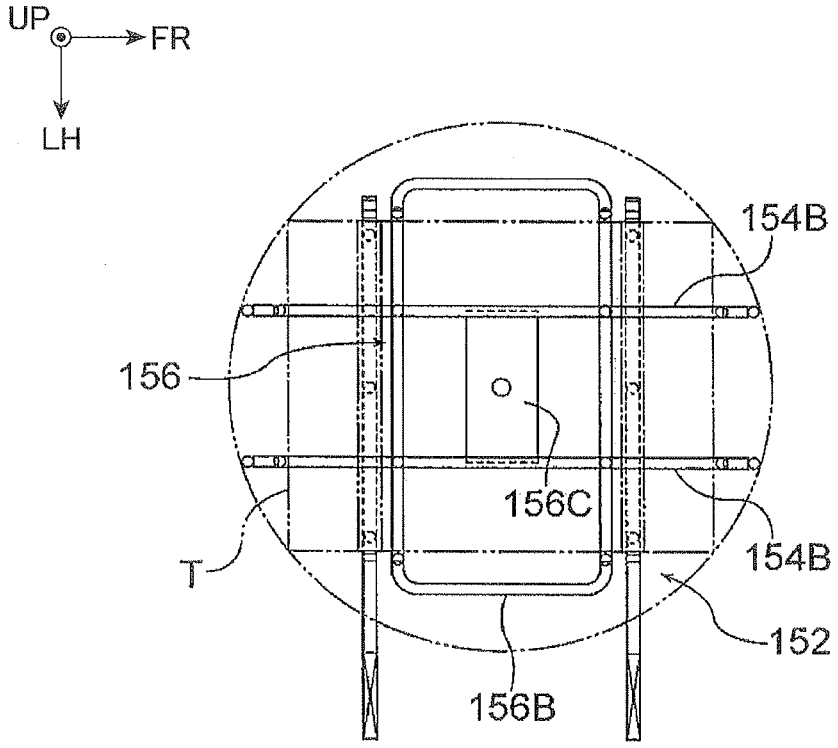
FIG. 19 is a view taken along line XIX-XIX of FIG. 18.

While a shape of the hanger unit 152 is substantially the same shape as the hanger unit 52 (see FIG. 4) according to the first embodiment when seen as a whole, in the following description, the shape will be described in detail with reference to FIGS. 17 to 19. FIGS. 18 and 19 show enlarged views of the hanger unit 152. FIG. 18 is a view taken along line XVIII-XVIII of FIG. 17, and FIG. 19 is a view taken along line XIX-XIX of FIG. 18. As shown in FIGS. 17 and 18, the hanger unit 152 includes a pair of frame sections 154. The frame section 154 has an upper frame section 154A, a lower frame section 154B, and a pair of side frame sections 154C. Then, as shown in FIGS. 17 to 19, the pair of frame sections 154 is parallelly installed in series to correspond to the opening sections.

As shown in FIGS. 17 and 18, the upper surface sections of the intermediate sections in the leftward/rightward width directions in the upper frame sections 154A of the pair of frame sections 154 are connected by a connecting plate section 155A, and the connecting plate section 155A is suspended from the hanging section 150. In addition, in the intermediate sections in the upward/downward directions of the side frame sections 154C of the pair of frame sections 154, opposite sections in a parallel installation direction of the pair of frame sections 154 are connected by a connecting pin 155B. Further, as shown in FIGS. 17 to 19, upper surface sections of the intermediate sections in the leftward/rightward width directions of the lower frame sections 154B of the pair of frame sections 154 are connected by a connecting section 156.

The connecting section 156 includes standing sections 156A protruding from the intermediate sections in the leftward/rightward width directions of the lower frame sections 154B of the pair of frame sections 154 and installed in parallel in the leftward/rightward width directions. The upper end sections of the standing section 156A are connected by a tray receiving section 156B having a substantially rectangular frame shape when seen in a plan view. The tray receiving sections 156B overhang from both sides in a parallel installation direction of the pair of frame sections 154 with respect to the pair of frame sections 154 when seen in a plan view. Then, the hanger unit 152 can insert the tray T into the opening section of the frame section 154, and place the tray T on the tray receiving section 156B of the connecting section 156. Further, the workpiece W is placed on the tray T as described above. In addition, lower surface sections of the intermediate sections in the leftward/rightward width directions of the lower frame sections 154B of the pair of frame sections 154 are connected by a connecting plate section 156C.

In addition, as shown in FIG. 18, convex sections 157 are formed in opposing sections of the pair of side frame sections 154C of the frame sections 154 at a height position slightly higher than the tray receiving section 156B. The convex sections 157 are projected outward in opposite directions of the pair of side frame sections 154C, and displacement in a lateral direction of the tray T is restricted as the convex sections 157 come in contact with side section lower ends of the tray T.

Further, protrusion pins 156P protrude upward from the tray receiving section 156B at an upper side of the standing section 156A. In a state in which the tray T is placed on the tray receiving section 156B, the protrusion pins 156P pass through the mesh of the tray T. Accordingly, the hanger unit 152 can stably support the tray T.

While the hanger unit 152 arrives at the device right side as the rotary 160 shown in FIG. 17 is rotated around the axis of the revolution shaft section 162, the above-mentioned projection machines 122 and 124 project the shot media toward the hanger unit 152 in this state. Further, a chain line extending from the projection machines 122 and 124 in the drawing is a centerline in the projection direction. The projection machines 122 and 124 serving as centrifugal projection machines include rotatable impellers (not shown) and the driving motors 123 and 125 (see FIG. 11) configured to drive the impellers, and applies a centrifugal force to the shot media by rotation of the impellers. That is, the projection machines 122 and 124 are configured to project the shot media accelerated by the centrifugal force according to the rotation of the impellers into the processing chambers R1 and R2 through the opening sections of the processing chambers R1 and R2. Further, the processing chambers R1 and R2 are disposed at the device right side in the vicinity of the projection machines 122 and 124 to become the projection chamber 120, and disposed at the device left side close to the loading/unloading device 200 to become an loading/unloading chamber (a pickup and take-down chamber) 121. Driving motors 123 and 125 configured to drive the impellers of the projection machines 122 and 124 shown in FIG. 11 are connected by the controller 164 (the connection state is not shown), and an operation thereof is controlled by the controller 164.

Figure 20:
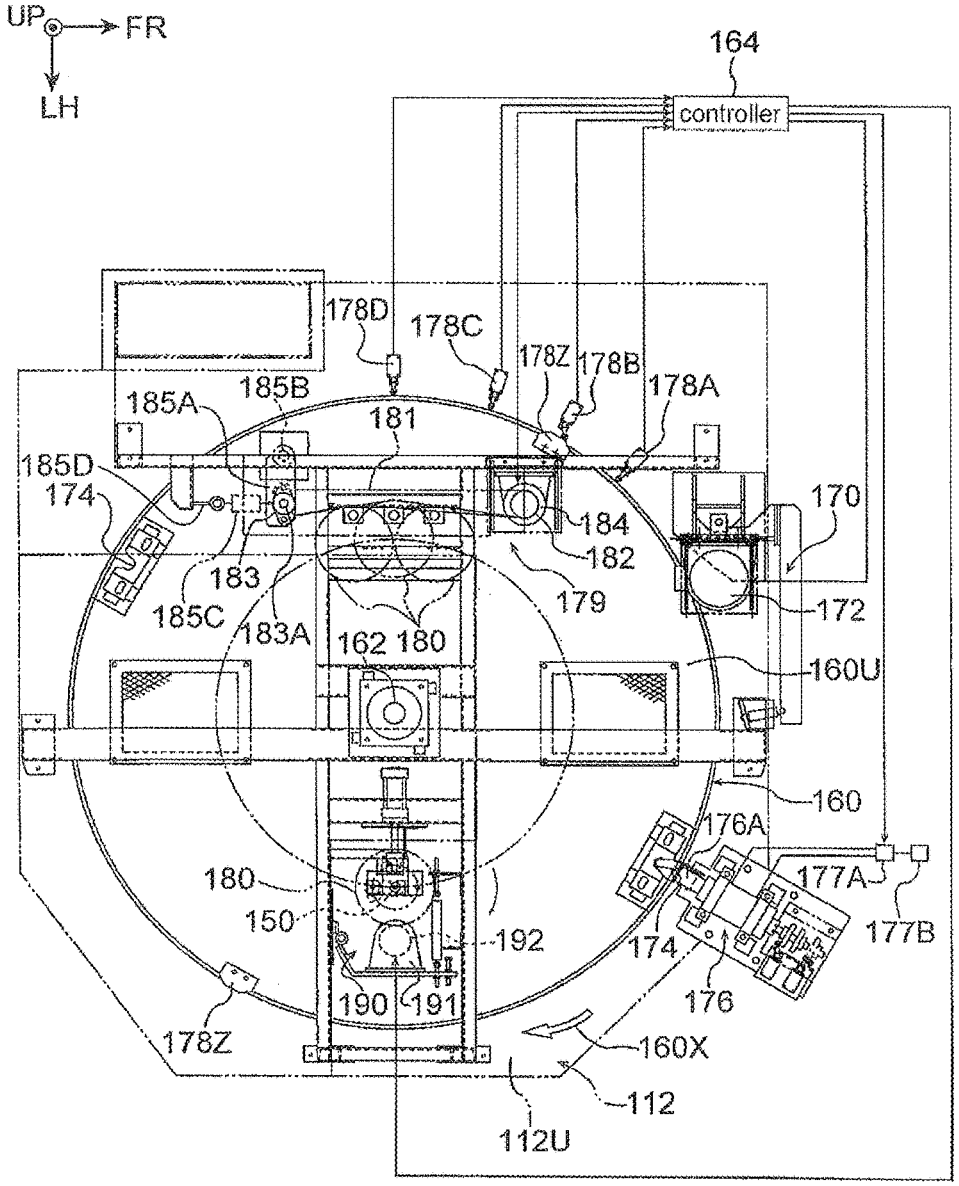
FIG. 20 is a plan view seen from a ceiling section side of a cabinet of the shot blasting device according to the second embodiment.

Next, a mechanism configured to revolve and autorotate the hanging section 150 and the hanger unit 152 shown in FIG. 17 will be described. FIG. 20 is a plan view seen from a ceiling section side of the cabinet 112. The rotary drive mechanism 170 is installed at the cabinet 112. The rotary drive mechanism 170 is configured to include the revolution shaft section 162 and the revolution driving motor 172, and revolve the hanging section 150 by rotating the rotary 160 around the axis of the rotary 160. Further, an arrow 160X shown in FIG. 20 represents a rotation direction of the rotary 160.

As shown in FIG. 17, the revolution shaft section 162 extends in the device upward/downward directions as the axial direction, an upper section thereof is attached to a central section of the ceiling section 160U of the rotary 160, and a lower section thereof is attached to a central section of a bottom plate section 160F of the rotary 160. In addition, areas of the revolution shaft section 162 disposed on and under the rotary 160 are supported by a frame of the cabinet 112 via shaft receiving sections 168A and 168B, and thus, can rotate around an axis thereof.

In addition, as shown in FIG. 20, a revolution driving motor 172 is installed at an outer circumferential side of the ceiling section 160U of the rotary 160, and an axial direction of the output shaft is set as the device upward/downward directions. A roller (not shown) is coaxially fixed to the output shaft of the revolution driving motor 172, and the roller comes in contact with the outer circumferential section of the ceiling section 160U of the rotary 160. Accordingly, the driving force of the revolution driving motor 172 is transmitted to the rotary 160 via the roller. That is, the rotary 160 is rotated around the axis of the revolution shaft section 162 in the device upward/downward directions by the operation of the revolution driving motor 172. The revolution driving motor 172 is connected to the controller 164, and an operation thereof is controlled by the controller 164.

In addition, a rotary drive mechanism 170 for a revolution lock includes locking units 174 fixed to predetermined positions of the ceiling section 160U of the rotary 160 opened in a concaved shape outside in the radial direction of the rotary 160, and a lock cylinder 176 disposed at an outer circumferential side of the ceiling section 160U of the rotary 160. In the embodiment, the locking units 174 are formed at two places of the rotary 160 at equal intervals in the circumferential direction. In addition, the lock cylinder 176 serving as a known air cylinder can expand and contract between a position at which a rod 176A is fitted into the locking unit 174 and a position separated from the outer circumference of the ceiling section 160U of the rotary 160.

The lock cylinder 176 is connected to an air supply source 177B via an air direction control mechanism (electromagnetic valve or the like) 177A, which is shown as a block, and the air direction control mechanism 177A is connected to the controller 164. The controller 164 controls a direction of expansion and contraction of the rod 176A of the lock cylinder 176 by controlling the air direction control mechanism 177A according to predetermined conditions.

In addition, the rotary drive mechanism 170, to which metal pieces 178Z are attached to an outer circumferential side of the ceiling section 160U of the rotary 160 at 180° intervals, includes a plurality of (in the embodiment, as an example, four) proximity switches 178A, 178B, 178C and 178D slightly separated from the outer circumference of the ceiling section 160U of the rotary 160 and disposed adjacent to each other. A part of the metal piece 178Z overhangs outside in the radial direction of the rotary 160 to be protruding from an outer circumferential surface of the rotary 160 when seen in a plan view of the device. In addition, the proximity switches 178A, 178B, 178C and 178D are configured to electrically connect an electric circuit (a control circuit unit) including the proximity switches 178A, 178B, 178C and 178D when the metal piece 178Z approaches a predetermined range. That is, in a state in which the rotary 160 arrives at a predetermined rotational angle position, as the metal piece 178Z approaches the proximity switches 178A, 178B, 178C and 178D, the proximity switches 178A, 178B, 178C and 178D detect the proximity of the metal piece 178Z, in other words, detect that the rotary 160 is at the predetermined rotational angle position.

The proximity switches 178A, 178B, 178C and 178D are connected to the controller 164. When the proximity switch 178B detects the proximity of the metal piece 178Z, the controller 164 controls the direction such that the rod 176A of the lock cylinder 176 extends to a position fitted into the locking unit 174 attached to the rotary 160 and then contracts to a position disengaged from the locking unit 174 by controlling the air direction control mechanism 177A based on the detection result. Precision of the revolution stoppage position of the rotary 160 becomes better by fitting the rod 176A into the locking unit 174. In addition, when the proximity switch 178B does not detect the proximity of the metal piece 178Z, the controller 164 controls the direction such that the rod 176A of the lock cylinder 176 is disposed outside in the radial direction of the rotary 160 farther than the locking unit 174 attached to the rotary 160 by controlling the air direction control mechanism 177A. Further, when the proximity switches 178B, 178C and 178D detect the proximity of the metal piece 178Z, the controller 164 controls to temporarily stop the revolution driving motor 172 based on the detection result.

Accordingly, the rotary drive mechanism 170 is configured to primarily stop the rotary 160 at predetermined positions (in the embodiment, positions corresponding to three positions of a chain wheel 180 shown by a two-dot chain line at an upper side of FIG. 20) of a projection area in which the projection machines 122 and 124 project shot media to the workpiece W (see FIG. 17) as revolution stoppage positions. Further, when the rotary 160 is primarily stopped at the revolution stoppage positions of the workpiece W, one chamber of the processing chambers R1 and R2 becomes the projection chamber 120, and the other chamber of the processing chambers R1 and R2 becomes the loading/unloading chamber 121.

Meanwhile, as shown in FIG. 17, an autorotation mechanism 179 configured to rotate the hanging section 150 around the axis of the hanging section 150 in the device upward/downward directions is installed at the rotary 160. Hereinafter, the autorotation mechanism 179 will be described.

A shaft member 151 is fixed to and suspended from the connecting plate section 156C of the lower section of the hanger unit 152 at a position overlapping the hanging section 150 when seen in a plan view of the device. The lower end section of the shaft member 151 is rotatably supported around the axis of the shaft member 151 by a shaft receiving section 161 installed at the bottom plate section 160F of the rotary 160.

The chain wheel 180 is coaxially fixed to the upper end section of the hanging section 150 at an upper side of the rotary 160. As shown in FIG. 20, the chain wheel 180 is configured to come in contact with a chain 181 when the hanger unit 152 (see FIG. 17) arrives at a predetermined position (a three-point stoppage position) of the projection zone according to rotation of the rotary 160. The chain 181 formed in an endless shape is wound on a driving-side chain wheel 182 and a driven-side chain wheel 183. The driving-side chain wheel 182 is coaxially fixed to a motor shaft of a driving motor 184, and the driving motor 184 is fixed to the device frame, connected to the controller 64 and driven at a predetermined time (in the embodiment, when enters a power supply of a device main body).

The driven-side chain wheel 183 constitutes a pillow unit, and a shaft section 183A is rotatably attached to a front end section of an aim body 185A. The arm body 185A has a base end section swingable about a rotary shaft 185B in the device upward/downward directions, and a front end section attached to a tension bolt 185D via a spring 185C. The tension bolt 185D is fixed to the device frame. Accordingly, the driven-side chain wheel 183 normally receives a tensile force in a left side of the drawing. For this reason, the chain 181 is configured to transmit the driving force from the driving motor 184 to the chain wheel 180 when the chain wheel 180 is in a predetermined position range. That is, the autorotation mechanism 179 rotates the hanging section 150 around the axis of the hanging section 150 in the device upward/downward directions using the driving force from the driving motor 184. Further, in this structure, an unreasonable load cannot be easily applied to the chain 181 and the chain wheel 180.

In addition, as shown in FIGS. 17 and 20, in a ceiling section 112U of the cabinet 112, an autorotation mechanism 190 is also installed at the device left side to/from which the tray T is loaded/unloaded. The autorotation mechanism 190 includes a driving motor 191 attached to the ceiling section 112U of the cabinet 112. A roller 192 is coaxially fixed to the output shaft of the driving motor 191. A diameter of the roller 192 is set to be smaller than a diameter of the chain wheel 180. The roller 192 can come in contact with the chain wheel 180 and transmit the driving force of the driving motor 191. That is, the autorotation mechanism 190 rotates the hanging section 150 around the axis of the hanging section 150 in the device upward/downward directions by driving the driving motor 191.

Meanwhile, an angle position detection unit 193 (in the drawing, shown as a block) is formed at the shaft receiving section 161 configured to rotatably support the shaft member 151 hanging from the hanger unit 152 shown in FIG. 17. As an example, the angle position detection unit 193 is a proximity switch installed at the upper end section of the shaft receiving section 161 outside in the radial direction of the rotary 160. On the other hand, a metal piece 194 (see FIG. 18) is formed at the shaft member 151. The metal piece 194 shown in FIG. 18 is attached to a front surface near the lower section of the shaft member 151 when seen in a front view of the hanger unit 152 shown in FIG. 18 (when seen in a direction in which the opening section of the frame section 154 is directed to the front surface). In addition, the angle position detection unit 193 shown in FIG. 17 is configured to electrically connect the electric circuit (the control circuit unit) including the angle position detection unit 193 when the metal piece 194 (see FIG. 18) approaches. Accordingly, in a state in which the roller 192 and the chain wheel 180 of the autorotation mechanism 190 come in contact with each other at the upper side of the rotary 160, the angle position detection unit 193 is configured to detect the initial setting position set such that the opening section of the frame section 154 of the hanger unit 152 in the rotational angle positions around the axis in the device upward/downward directions of the hanging section 150 is directed toward the loading/unloading device 200 (a side of an arm 207 to be described below).

In addition, the driving motor 191 and the angle position detection unit 193 (see FIG. 17) shown in FIG. 20 are connected to the controller 164 serving as the autorotation control unit. The controller 164 can control an operation of the driving motor 191 of the autorotation mechanism 190 to stop the hanging section 150 at the initial setting position based on the detection result of the angle position detection unit 193 (see FIG. 17).

(Configuration of Loading/unloading Device Outside Cabinet)

Meanwhile, as shown in FIG. 14, the loading/unloading device 200 interposed between the loading roller conveyor 104 and the unloading roller conveyor 108 includes a traveling body 202. The traveling body 202 can travel in a direction perpendicular to the transportation direction of the intermediate roller conveyor 106. A rod front end section of a driving cylinder 204 having the device leftward/rightward direction as an axial direction is fixed to the traveling body 202. The driving cylinder 204 serving as a known air cylinder is attached to a device frame 208 of the loading/unloading device 200, and the traveling body 202 is reciprocally moved (travels in the device leftward/rightward direction) in the device leftward/rightward direction as the rod of the driving cylinder 204 is expanded and contracted in the device leftward/rightward direction.

As shown in FIG. 11, the driving cylinder 204 is connected to an air supply source 212 via an air direction control mechanism (electromagnetic valve or the like) 210, which is shown as a block, and the air direction control mechanism 210 is connected to the controller 164. The controller 164 controls a direction of expansion and contraction of the rod of the driving cylinder 204 by controlling the air direction control mechanism 210.

The arm 207 is attached to the traveling body 202 via elevating cylinders 205 and 206 serving as elevating mechanisms having the device upward/downward directions as an axial direction. The elevating cylinders 205 and 206 serving as known air cylinders are attached to the arm 207, and the rods of the elevating cylinders 205 and 206 expand and contract in the device upward/downward directions to elevate the arm 207 in the device upward/downward directions.

The elevating cylinder 205 is connected to the air supply source 212 via an air direction control mechanism (an electromagnetic valve or the like) 213 which is shown as a block, and the elevating cylinder 206 is connected to the air supply source 212 via an air direction control mechanism (an electromagnetic valve or the like) 214 which is shown as a block. The air direction control mechanisms 213 and 214 are connected to the controller 164. The controller 164 controls a direction of expansion and contraction of the rod of the elevating cylinder 205 by controlling the air direction control mechanism 213, and controls a direction of expansion and contraction of the rod of the elevating cylinder 206 by controlling the air direction control mechanism 214.

As shown in FIG. 17, the arm 207 is a member configured to receive the tray T between the intermediate roller conveyor 106 side and the hanger unit 152 side (the loading/unloading chamber 121), and is withdrawn to a lower gap between the conveyor rollers 106A (see FIG. 14) of the intermediate roller conveyor 106 upon non-operation. The arms 207 are installed as a pair at left and right sides, can be inserted into left and right sides of the connecting section 156 in the opening section of the frame section 154 of the hanger unit 152 shown in FIG. 18, and can place and convey the tray T on which the workpiece W is placed. The thickness ti in the upward/downward direction of the placing section on which the tray T is placed in the arm 207 shown in FIG. 17 is set to be smaller than the distance L1 in the upward/downward direction between the placing surface of the tray T of the connecting section 156 shown in FIG. 18 (the upper surface of the tray receiving section 156B) and the upper surface of the lower frame section 154B. The loading/unloading device 200 shown in FIG. 11 is configured to load/unload the tray T with respect to the hanger unit 152 by advancing and retracting the arm 207 by the operation of the driving cylinder 204.

(Flow and Action/effect of Processing)

Next, an action and an effect of the embodiment will be described while schematically describing a flow of the process using the shot blasting device 100 shown in FIG. 10 or the like. Further, while the operations of the mechanisms are controlled by the controller 164, in the following description, description of the control by the controller 164 will be appropriately omitted.

First, the trays T stacked in the two stages are placed on the loading roller conveyor 104 shown in FIG. 10 by an operator or a robot arm. The loading roller conveyor 104 transports the trays T stacked in the two stages toward the intermediate roller conveyor 106. Then, the trays T stacked in the two stages are transmitted to the front of the loading/unloading device 200 by the intermediate roller conveyor 106.

As shown in FIG. 17, the loading/unloading device 200 is configured such that the arms 207 constituting a part thereof can be inserted into the opening section of the frame section 154 of the hanger unit 152 and the tray T on which the workpiece W is placed can be conveyed. Then, the loading/unloading device 200 supports the tray T on the intermediate roller conveyor 106 by raising the arms 207, and loads the tray T to the hanger unit 152 by advancing the arms 207. In the state in which the tray T is placed on the hanger unit 152 as described above, shot blast processing to be described is performed. For this reason, even when a type of the workpiece W is varied, the shot blast processing can be performed without exchanging the jig. Accordingly, as an exchanging time of the jig is removed, a processing time when a variety of workpieces are processed can be reduced.

In addition, upon loading of the tray T, the pair of arms 207 is inserted into left and right sides of the connecting section 156 in the opening section of the frame section 154. Here, in the embodiment, the thickness ti in the upward/downward direction of the placing section on which the tray T is placed in the arms 207 is set to be smaller than the distance L1 in the upward/downward direction between the placing surface of the tray T of the connecting section 156 of the hanger unit 152 shown in FIG. 18 and the upper surface of the lower frame section 154B. For this reason, as shown in FIG. 17, after the arms 207 on which the tray T is placed advance to be inserted into the left and right sides of the connecting section 156 in the opening section of the frame section 154, when the elevating cylinder 206 of the loading/unloading device 200 lowers the arms 207, the tray T can be placed on the connecting section 156 of the hanger unit 152, and then, only the arms 207 can be withdrawn. That is, the tray T can be stably loaded into the hanger unit 152 while providing a simple configuration.

In addition, among the rotational angle positions around the axis in the device upward/downward directions of the hanging section 150, the initial setting position set such that the opening section of the frame section 154 of the hanger unit 152 is directed toward the arms 207 is detected by the angle position detection unit 193. Then, when the hanger unit 152 is disposed at a facing area of the loading/unloading device 200, based on the detection result of the angle position detection unit 193, the controller 164 shown in FIG. 20 controls an operation of the autorotation mechanism 190 to stop the hanging section 150 at the initial setting position. For this reason, when the tray T shown in FIG. 17 is loaded into/unloaded, from the hanger unit 152, the arms 207 are easily inserted into the frame section 154 of the hanger unit 152.

In addition, as shown in FIG. 20, as the rotary drive mechanism 170 installed at the rotary 160 rotates the rotary 160 around the axis of the rotary 160, the hanging section 150 installed at the ceiling section 160U of the rotary 160 is revolved. Then, the rotary drive mechanism 170 primarily stops the rotary 160 having a predetermined position of the projection area in which the shot media is projected to the workpiece W shown in FIG. 17 by the projection machines 122 and 124 as a revolution stoppage position. Further, at the primary stoppage position, based on the detection result of the proximity switches 178B, 178C and 178D shown in FIG. 20, the controller 164 controls the air direction control mechanism 177A and the revolution driving motor 172.

As shown in FIG. 17, when the rotary 160 is primarily stopped, in the two processing chambers R1 and R2, one is disposed in the projection area of the device right side, and the other is disposed in the loading/unloading area of the device left side. Accordingly, upon projection by the projection machines 122 and 124, the tray T from the rotary 160 can be unloaded and loaded in an area other than the projection area. Accordingly, the processing time as a whole can be reduced.

In addition, the tray T arrived at the projection area is autorotated as the autorotation mechanism 179 autorotates the hanging section 150 and the hanger unit 152. In the autorotation state, the projection machines 122 and 124 project the shot media to the workpiece W on the tray T. The tray T on which the workpiece W after the shot blast processing is placed is returned to the loading/unloading area of the device left side again as the rotary 160 revolves.

Next, after the arms 207 advances to be inserted into the left and right sides of the connecting section 156 in the opening section of the frame section 154, the loading/unloading device 200 unloads the tray T from the hanger unit 152 by raising and retracting the arms 207. Then, the loading/unloading device 200 places the tray T on the intermediate roller conveyor 106 by lowering the arms 207. As shown in FIG. 14, the tray T transported to the front of the device by the intermediate roller conveyor 106 is pressed to the unloading roller conveyor 108 by the unloading pusher 107, and then, unloaded by the unloading roller conveyor 108.

As described above, according to the shot blasting device 100 of the embodiment, a processing time when a variety of workpieces W are processed can be reduced.

[Supplementary Description of Embodiments]

Further, in the embodiment, while the shot processing device is the shot blasting device 10 or 100, the shot processing device may be a shot peening device or may be a shot blasting device combined with a shot peening device.

In addition, a lower opening door or a lateral opening door may be provided instead of the elevating door 14 according to the embodiment shown in FIG. 1 or the like. In addition, a mechanism configured to elevate the transportation roller conveyor 76 according to the first embodiment may be installed, or the rails configured to guide the trolley 86A of the loading/unloading device 86 shown in FIG. 3 may extend to the upper side of the transportation roller conveyor 76.

In addition, as a modification of the embodiment, the arm of the loading/unloading device may be another arm such as an arm configured to grip and convey the tray, or the like.

In addition, as a modification of the embodiment, concave sections into which arms concaved toward the lower side at a position in the width direction corresponding to the arms can be inserted by the lower frame section of the frame section without installing the connecting section configured to connect the lower frame sections of the frame sections may be formed.

In addition, as a modification of the embodiment, the hanging section may be set to the initial setting position at a predetermined time using a robot arm or the like, without installing the angle position detection units 66 and 193 (see FIGS. 2 and 17).

In addition, as the modification of the first embodiment, the loading-side delivery unit may be, for example, a loading-side delivery unit such as the loading-side delivery belt conveyor or the placing table for loading-side delivery or the like, other than the loading-side delivery roller conveyor 74. In addition, as the modification of the first embodiment, the transportation conveyor may be, for example, a transportation conveyor such as the transportation belt conveyor or the like, other than the transportation roller conveyor 76. Further, as the modification of the first embodiment, the unloading-side delivery unit may be, for example, an unloading-side delivery unit such as the unloading-side delivery belt conveyor, the placing table for unloading-side delivery, or the like, other than the unloading-side delivery roller conveyor 78.

In addition, a concept of "gripping the tray" described in claim 4 includes supporting the tray by holding the tray from both sides like the embodiment, in addition to supporting the tray by gripping the tray from both sides.

In addition, as a modification of the above embodiments, the elevating mechanism of the loading/unloading device may be, for example, another elevating mechanism including an elevating motor and a ball screw mechanism. In addition, as a modification of the first embodiment, the elevating unit of the stacking device may be, for example, another elevating unit such as a cylinder or the like.

In addition, as a modification of the first embodiment, the biasing mechanism constituting a part of the clamp may be, for example, a biasing mechanism, other than the tensile coil spring 90L shown in FIG. 5, such as a leaf spring, a volute spring, or the like.

In addition, in the first embodiment, while the spraying device 92 shown in FIG. 6 is installed, a configuration in which the spraying device 92 is not installed may be employed.

Further, the embodiments and the plurality of modifications as described above may be appropriately combined and performed.

Hereinabove, while the example of the present invention has been described, the present invention is not limited thereto but various modifications may be made without departing from the spirit of the present invention.

REFERENCE SIGNS LIST

10 . . . shot blasting device (shot processing device), 12 . . . cabinet, 22 . . . projection machine, 24 . . . projection machine, 50 . . . hanging section, 52 . . . hanger unit, 54 . . . frame section, 54A . . . upper frame section, 54B . . . lower frame section, 54C . . . side frame section, 56 . . . connecting section, 62 . . . autorotation mechanism, 64 . . . controller (autorotation control unit), 66 . . . angle position detection unit, 74 . . . loading-side delivery roller conveyor (loading-side delivery unit), 76 . . . transportation roller conveyor (transportation conveyor), 78 . . . unloading-side delivery roller conveyor (unloading-side delivery unit), 84 . . . dispensing device, 86 . . . loading/unloading device, 86E . . . elevating cylinder (elevating mechanism), 86F . . . elevating cylinder (elevating mechanism), 86G . . . arm, 88 . . . stacking device, 88H . . . elevating unit, 90 . . . clamp, 90J . . . clamp jaw, 90J1 . . . support posture, 90J2 . . . retract posture, 90L . . . tensile coil spring (biasing mechanism), 92 . . . spraying device, 94A . . . autorotation mechanism, 94J . . . autorotation shaft section (hanging section), 100 . . . shot blasting device (shot processing device), 112 . . . cabinet, 122 . . . projection machine, 124 . . . projection machine, 150 . . . hanging section, 152 . . . hanger unit, 154 . . . frame section, 154A . . . upper frame section, 154B . . . lower frame section, 154C . . . side frame section, 156 . . . connecting section, 160 . . . rotary, 160U . . . ceiling section of rotary, 164 . . . controller (autorotation control unit), 165 . . . partition section, 170 . . . rotary drive mechanism, 179 . . . autorotation mechanism, 193 . . . angle position detection unit, 200 . . . loading/unloading device, 205 . . . elevating cylinder (elevating mechanism), 206 . . . elevating cylinder (elevating mechanism), 207 . . . arm, R1, R2, processing chamber, T . . . tray, W . . . workpiece.

The invention claimed is:

1. A shot processing device having:

a cabinet formed in a box shape;

a hanging section installed in the cabinet, suspended from a ceiling of the cabinet, extending in upward/downward directions of the cabinet, and having an axis extending in the upward/downward directions;

an autorotation mechanism including a motor and configured to rotate the hanging section around the axis of the hanging section using the motor;

a hanger unit suspended from the hanging section and installed in the cabinet, and including a pair of frame sections each having an upper frame section, a lower frame section provided below the upper frame section, and a pair of side frame sections connecting both ends, of the upper frame section and both ends of the lower frame, wherein the pair of frame sections each includes an opening section defined by the upper frame section, a lower frame section, and a pair of side frame sections, and the pair of frame sections is parallelly installed so that opening sections face each other;

a projection machine including rotatable impellers and configured to project a shot media toward the hanger unit using rotatable impellers; and a loading/unloading device installed adjacent to the cabinet, including an arm insertable into the opening section of the frame section of the hanger unit and a cylinder advancing and retracting the arm, wherein the arm conveys a tray on which a workpiece is placed, and loads the tray into/unloaded from the hanger unit by operation of the cylinder.

2. The shot processing device according to claim 1, wherein in the hanger unit, upper surface sections of intermediate sections in leftward/rightward width directions of the lower frame sections of the pair of frame sections are connected by a connecting section, and the tray is able to be placed on the connecting section, the arm is provided in a pair, and the pair of arms is installed to place the tray and insertable into left and right sides of the connecting section in the opening section of the frame section, and the thickness in the upward/downward directions of a placing section on which the tray is placed in the arms is set to be smaller than a distance in the upward/downward direction between a placing surface of the tray of the connecting section and an upper surface of the lower frame section, and the loading/unloading device includes an elevating mechanism configured to elevate the arms.

3. The shot processing device according to claim 1, having an angle position detection unit configured to detect an initial setting position such that the opening section of the frame section of the hanger unit is directed toward the arm, among rotational angle positions around the axis in the device upward/downward directions of the hanging section, and an autorotation control unit configured to control an operation of the autorotation mechanism to stop the hanging section at the initial setting position based on a detection result of the angle position detection unit.

4. The shot processing device according to claim 2, having an angle position detection unit configured to detect an initial setting position such that the opening section of the frame section of the hanger unit is directed toward the arm, among rotational angle positions around the axis in the device upward/downward directions of the hanging section, and an autorotation control unit configured to control an operation of the autorotation mechanism to stop the hanging section at the initial setting position based on a detection result of the angle position detection unit.

5. The shot processing device according to claim 1, having a loading-side delivery unit installed outside the cabinet and configured to place the trays in a state of stacked in a plurality of stages, a transportation conveyor installed outside the cabinet, having an upstream side in a transportation direction disposed in the vicinity of the loading-side delivery unit, disposed to cross an operation region of the loading/unloading device, and configured to transport the tray, an unloading-side delivery unit installed outside the cabinet, disposed in the vicinity of the downstream side in the transportation direction of the transportation conveyor, and configured to place the trays in the state of stacked in the plurality of stages, a dispensing device installed in the vicinity of the loading-side delivery unit and the upstream side in the transportation direction of the transportation conveyor, and configured to sequentially transfer the trays stacked in the plurality of stages of the loading-side delivery unit from the tray of an upper stage side to be placed on the transportation conveyor, and a stacking device installed in the vicinity of the downstream side in the transportation direction of the transportation conveyor and the unloading-side delivery unit, wherein the loading/unloading device loads the tray transferred by the dispensing device and transported by the transportation conveyor to the hanger unit, and unloads the tray from the hanger unit to place the tray on the transportation conveyor, and the stacking device is able to be on standby while gripping and raising the tray unloaded by the loading/unloading device and transported by the transportation conveyor, and lowers and grips the tray when another tray is transmitted to immediately under the standby position, and further places the trays in the state of stacked in the plurality of stages on the unloading-side delivery unit.

6. The shot processing device according to claim 2, having a loading-side delivery unit installed outside the cabinet and configured to place the trays in a state of stacked in a plurality of stages, a transportation conveyor installed outside the cabinet, having an upstream side in a transportation direction disposed in the vicinity of the loading-side delivery unit, disposed to cross an operation region of the loading/unloading device, and configured to transport the tray, an unloading-side delivery unit installed outside the cabinet, disposed in the vicinity of the downstream side in the transportation direction of the transportation conveyor, and configured to place the trays in the state of stacked in the plurality of stages, a dispensing device installed in the vicinity of the loading-side delivery unit and the upstream side in the transportation direction of the transportation conveyor, and configured to sequentially transfer the trays stacked in the plurality of stages of the loading-side delivery unit from the tray of an upper stage side to be placed on the transportation conveyor, and a stacking device installed in the vicinity of the downstream side in the transportation direction of the transportation conveyor and the unloading-side delivery unit, wherein the loading/unloading device loads the tray transferred by the dispensing device and transported by the transportation conveyor to the hanger unit, and unloads the tray from the hanger unit to place the tray on the transportation conveyor, and the stacking device is able to be on standby while gripping and raising the tray unloaded by the loading/unloading device and transported by the transportation conveyor, and lowers and grips the tray when another tray is transmitted to immediately under the standby position, and further places the trays in the state of stacked in the plurality of stages on the unloading-side delivery unit.

7. The shot processing device according to claim 5, wherein the stacking device comprises:

an elevating unit configured to elevate a clamp configured to grip the tray;

a clamp jaw constituting a part of the clamp and rotatable around an axis in a horizontal direction between a support posture at which the clamp jaw is able to support a bottom surface of the tray and a retract posture at which the clamp jaw is rotated upward to be retracted when coming in contact with a side surface of the tray upon lowering; and a biasing mechanism constituting a part of the clamp and configured to bias the clamp jaw in a direction from a rotational angle position of the retract posture toward a rotational angle position of the support posture.

8. The shot processing device according to claim 6, wherein the stacking device comprises:

an elevating unit configured to elevate a clamp configured to grip the tray;

a clamp jaw constituting a part of the clamp and rotatable around an axis in a horizontal direction between a support posture at which the clamp jaw is able to support a bottom surface of the tray and a retract posture at which the clamp jaw is rotated upward to be retracted when coming in contact with a side surface of the tray upon lowering; and a biasing mechanism constituting a part of the clamp and configured to bias the clamp jaw in a direction from a rotational angle position of the retract posture toward a rotational angle position of the support posture.

9. The shot processing device according to claim 1, having a spraying device configured to spray a gas toward the hanger unit in the cabinet.

10. The shot processing device according to claim 2, having a spraying device configured to spray a gas toward the hanger unit in the cabinet.

11. The shot processing device according to claim 1, comprising:

a rotary rotatably installed around the axis in the device upward/downward directions in the cabinet to divide a space around the axis by partition sections such that a plurality of processing chambers are installed in parallel in a circumferential direction, and opening sections opened at an outer circumferential side and used for loading of the tray, unloading of the tray and passing of a shot media are formed in the processing chambers; and a rotary drive mechanism configured to rotate the rotary around the axis of the rotary, wherein the projection machine projects a shot media into the processing chamber through the opening section of the processing chamber, the hanging section is installed at a ceiling section of the rotary, and the rotary drive mechanism revolves the hanging section by rotating the rotary, and primarily stops the rotary using a predetermined position of a projection area in which shot media is projected toward a workpiece by the projection machine as a revolution stoppage position.

12. The shot processing device according to claim 2, comprising:

a rotary rotatably installed around the axis in the device upward/downward directions in the cabinet to divide a space around the axis by partition sections such that a plurality of processing chambers are installed in parallel in a circumferential direction, and opening sections opened at an outer circumferential side and used for loading of the tray, unloading of the tray and passing of a shot media are formed in the processing chambers; and a rotary drive mechanism configured to rotate the rotary around the axis of the rotary, wherein the projection machine projects a shot media into the processing chamber through the opening section of the processing chamber, the hanging section is installed at a ceiling section of the rotary, and the rotary drive mechanism revolves the hanging section by rotating the rotary, and primarily stops the rotary using a predetermined position of a projection area in which shot media is projected toward a workpiece by the projection machine as a revolution stoppage position.

* * * * *